US010782639B2

(12) United States Patent
Tokuma et al.

(10) Patent No.: US 10,782,639 B2
(45) Date of Patent: Sep. 22, 2020

(54) MEASUREMENT APPARATUS, IMAGE FORMING APPARATUS AND IMAGE FORMING SYSTEM

(71) Applicant: CANON KABUSHIKI KAISHA, Tokyo (JP)

(72) Inventors: Naoto Tokuma, Kashiwa (JP); Kenichi Hirota, Joso (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/539,036

(22) Filed: Aug. 13, 2019

(65) Prior Publication Data

US 2020/0089150 A1 Mar. 19, 2020

(30) Foreign Application Priority Data

Sep. 13, 2018 (JP) ..... 2018-171601

(51) Int. Cl.
*G03G 15/00* (2006.01)
*B65H 29/60* (2006.01)
*B65H 31/24* (2006.01)

(52) U.S. Cl.
CPC ..... *G03G 15/5041* (2013.01); *B65H 29/60* (2013.01); *B65H 31/24* (2013.01); *G03G 15/5062* (2013.01); *G03G 15/6529* (2013.01); *G03G 15/6573* (2013.01); *G03G 2215/00067* (2013.01); *G03G 2215/00421* (2013.01); *G03G 2215/00569* (2013.01)

(58) Field of Classification Search
CPC ..... G03G 15/5041; G03G 15/6529; G03G 15/6573; G03G 2215/00417; G03G 2215/00421; G03G 15/5062; G03G 2215/00426; G03G 15/6582; G03G 2215/00067; G03G 2215/00569; B65H 29/60; B65H 31/24
See application file for complete search history.

(56) References Cited

U.S. PATENT DOCUMENTS 5,852,764 A * 12/1998 Kida ..... B65H 29/60 399/401
6,959,157 B2 10/2005 Nakayama
(Continued)

FOREIGN PATENT DOCUMENTS

JP 2004-086013 A 3/2004
JP 2009128885 A * 6/2009
JP 2013-054324 A 3/2013

*Primary Examiner* — Walter L Lindsay, Jr.
*Assistant Examiner* — Laura Roth
(74) *Attorney, Agent, or Firm* — Venable LLP

(57) ABSTRACT

A measurement apparatus includes a sheet stacking portion provided above a first conveyance path and on which a second sheet discharged out of a second conveyance path is stacked. The sheet stacking portion includes an extension tray configured to support the sheet discharged out of the second conveyance path and to be movable between a first position and a second position, the first position being a position where the extension tray is located inside a width of the measurement apparatus in the horizontal direction, and the second position being a position where the extension tray is located above an upstream apparatus and is overlapped with the upstream apparatus when viewed in a gravity direction.

9 Claims, 16 Drawing Sheets

(56) References Cited

U.S. PATENT DOCUMENTS

| | | | | |
|---|---|---|---|---|
| 9,102,497 | B2 | 8/2015 | Tokuma | |
| 9,890,011 | B2 | 2/2018 | Tokuma | |
| 2003/0058251 | A1* | 3/2003 | Nakayama | H04N 1/00002 345/589 |
| 2005/0207768 | A1* | 9/2005 | Suzuki | G03G 15/5062 399/49 |
| 2011/0194860 | A1* | 8/2011 | Peng | G03G 15/5062 399/15 |
| 2013/0243451 | A1* | 9/2013 | Hirota | G03G 15/5062 399/39 |
| 2016/0154359 | A1* | 6/2016 | Watanabe | B65H 5/36 271/225 |
| 2017/0174464 | A1* | 6/2017 | Tanaka | B65H 31/20 |
| 2017/0219984 | A1* | 8/2017 | Kitamura | B65H 29/58 |
| 2017/0255156 | A1* | 9/2017 | Tokuma | B65H 31/22 |
| 2018/0262639 | A1* | 9/2018 | Anezaki | H04N 1/121 |

* cited by examiner

FIG.5

Header size: 270176 bytes
CMMYType: 'appl'
version: 0x02002001
profileClose: 'Drtr'
dataColorSpace: 'CMYK'
interchangeSpace: 'XYZ'
CreationDate: 3.4.1996, 19:16:14
CS23ignature: 'acsp' prim.platform: 'APPL'
flags: 0x00000000
deviceManufacturer: 'EF1'
deviceModel: 0
deviceAttributes: 0x00000000, 0x00000000
renderingIntent: 2
white XYZ: X = 0.9642, Y = 1.0000, Z= 0.8249

Tag Table <10 elements, double-click to inspect>

| Ind | Signet. | elementoffset | size |
|---|---|---|---|
| 0 | 'A2B0' | 252 = 0x000000FC | 43002 |
| 1 | 'B2A0' | 43256 = 0x0000A8F8 | 42940 |
| 2 | 'A2B1' | 86196 = 0x00015084 | 43002 |
| 3 | 'B2A1' | 129200 = 0x0001F880 | 42940 |
| 4 | 'A2B2' | 172140 = 0x0002A06C | 43002 |
| 5 | 'B2A2' | 215144 = 0x00034868 | 42940 |
| 6 | 'gamt' | 258084 = 0x0003F024 | 11925 |
| 7 | 'desc' | 270012 = 0x00041EBC | 125 |
| 8 | 'cprt' | 270140 = 0x00041F3C | 14 |
| 9 | 'wtpt' | 270156 = 0x00041F3C | 20 |
| | | | |
| | | | |
| | | | |
| | | | |
| | | | |
| | | | |

FIG.9

| 900 SHEET NAME | LENGTH IN SUB-SCANNING DIRECTION (mm) | LENGTH IN MAIN-SCANNING DIRECTION (mm) | GRAMMAGE (g/m^2) | SURFACE NATURE | COLOR | PRE-PRINT | 901 GEOMETRIC ADJUSTMENT (FRONT) | 902 GEOMETRIC ADJUSTMENT (BACK) |
|---|---|---|---|---|---|---|---|---|
| 910 ABC PAPER CO. RECYCLE 1 | 210 | 297 | 75 | PLAIN SHEET | WHITE | No | 0.3mm / -0.1mm<br>+0.02% / +0.01% | 0.2mm / 0.1mm<br>+0.02% / +0.03% |
| 911 ABC PAPER CO. RECYCLE 2 | 297 | 420 | 75 | PLAIN SHEET | WHITE | No | 0.0mm / -0.0mm<br>+0.00% / +0.00% | 0.0mm / -0.0mm<br>+0.00% / +0.00% |
| 912 DEF PAPER CO. EMBOSS A-1 | 216 | 279 | 150 | EMBOSS | WHITE | No | 0.5mm / -0.5mm<br>+0.02% / +0.02% | -0.3mm / 0.5mm<br>+0.01% / -0.03% |
| DEF PAPER CO. COATED SHEET P-1 | 279 | 432 | 128 | DOUBLE-SIDE COATED | WHITE | No | 0.4mm / -0.2mm<br>+0.12% / +0.08% | -0.2mm / 0.6mm<br>-0.02% / -0.01% |
| XYZ PAPER CO. COLOR B1 | 210 | 297 | 75 | PLAIN SHEET | ORANGE | No | 0.0mm / -0.0mm<br>+0.00% / +0.00% | 0.0mm / -0.0mm<br>+0.00% / +0.00% |
| XYZ PAPER CO. COLOR B2 | 210 | 297 | 75 | PLAIN SHEET | PINK | No | 0.0mm / -0.0mm<br>+0.00% / +0.00% | 0.0mm / -0.0mm<br>+0.00% / +0.00% |
| FGH PAPER CO. GRAPH PAPER 75 | 210 | 297 | 75 | PLAIN SHEET | WHITE | Yes | 0.0mm / -0.0mm<br>+0.00% / +0.00% | 0.0mm / -0.0mm<br>+0.00% / +0.00% |
| FGH PAPER CO. PLAIN SHEET 2 | 210 | 297 | 75 | PLAIN SHEET | WHITE | No | -0.03mm / -0.07mm<br>+0.06% / -0.01% | -0.03mm / -0.10mm<br>+0.04% / +0.02% |

LEAD POSITION / SIDE POSITION
MAIN-SCANNING MAGNIFICATION / SUB-SCANNING MAGNIFICATION

FIG.10A

1001

EDIT SHEET LIBRARY

| | SHEET NAME | LENGTH IN SUB-SCANNING DIRECTION (mm) | LENGTH IN MAIN-SCANNING DIRECTION (mm) | GRAMMAGE (g/m^2) | SURFACE NATURE | COLOR | |
|---|---|---|---|---|---|---|---|
| 910 | ABC PAPER CO. RECYCLE 1 | 210 | 297 | 75 | PLAIN SHEET | WHITE | △ |
| 911 | ABC PAPER CO. RECYCLE 2 | 210 | 420 | 75 | PLAIN SHEET | WHITE | |
| 912 | DEF PAPER CO. EMBOSS A-1 | 210 | 279 | 150 | EMBOSS | WHITE | |
| | DEF PAPER CO. COATED SHEET P-1 | 210 | 432 | 128 | DOUBLE-SIDE COATED | WHITE | |
| | XYZ PAPER CO. COLOR B1 | 210 | 297 | 75 | PLAIN SHEET | ORANGE | |
| | XYZ PAPER CO. COLOR B2 | 210 | 297 | 75 | PLAIN SHEET | PINK | ▽ |

ADD ITEM | EDIT | DELETE | ADJUST PRINTING POSITION

1002

FIG.10B

1003

<ADJUST PRINTING POSITION: SELECT ADJUSTING METHOD>

MANUALLY ADJUST

1004

ADJUST BY READING TEST PAGE

1005

MEASUREMENT APPARATUS, IMAGE FORMING APPARATUS AND IMAGE FORMING SYSTEM

BACKGROUND OF THE INVENTION

Field of the Invention

The present invention relates to a measurement apparatus measuring an image on a sheet, an image forming apparatus forming the image on the sheet and an image forming system forming the image on the sheet.

Description of the Related Art

There have been known an image forming apparatus and an image forming system provided with a sensor for measuring an image pattern formed on a sheet by the image forming apparatus and changing an image forming condition based on a result measured by the sensor. For instance, Japanese Patent Application Laid-open Nos. 2004-086013 and 2013-054324 disclose an image forming apparatus provided with a sensor for acquiring spectral reflectance of a patch image on a sheet and configured to change process conditions, e.g., a gradation correcting table and values of various bias voltages, of an electrophotographic unit based on measurement results of the sensor.

By the way, a sheet on which an image pattern is formed for adjusting an image forming condition is normally an unnecessary print for a user. Therefore, if a printed product necessary for the user and the sheet on which the adjustment image pattern has been formed are stacked on the same sheet discharge tray, it is inconvenient for the user because it is necessary to manually separate them.

In using such sensor detecting the image pattern as described in the above documents, it has been also known that in some cases measurement accuracy drops because a color of the image pattern changes or a thermos-noise level fluctuates due to a thermochromism phenomenon depending on peripheral temperature. Therefore, if the sensor for measuring the image pattern is disposed at a location susceptible to heat, it is concerned that the measuring accuracy may drop. For instance, if the sensor is disposed along or above a conveyance path through which sheets on which images have been formed by a thermo-fixing electrophotographic process frequently pass, the measuring accuracy is likely to drop due to the influence of heat.

SUMMARY OF THE INVENTION

The present invention provides a measurement apparatus, an image forming apparatus and an image forming system which can improve user convenience and reduce thermal effect to maintain high measuring accuracy.

According to one aspect of the invention, a measurement apparatus includes: a first conveyance path configured to receive a sheet discharged out of an image forming apparatus in the image forming system and to convey the sheet toward a downstream apparatus connected with and disposed downstream of the measurement apparatus in the image forming system; a second conveyance path branched from the first conveyance path, extended below the first conveyance path, and merged with the first conveyance path; a measuring portion disposed on the second conveyance path and configured to measure a test image on the sheet; a third conveyance path provided above the first conveyance path and configured to convey the sheet from which the test image has been measured by the measuring portion in the second conveyance path; and a sheet stacking portion which is provided above the first conveyance path and on which the sheet discharged out of the third conveyance path is stacked.

According to another aspect of the invention, an image forming system includes: an image forming apparatus including an image forming unit configured to form an image on a sheet in accordance with an image forming condition; a measurement apparatus connected with the image forming apparatus; and a downstream apparatus connected with the measurement apparatus, wherein the measurement apparatus includes: a first conveyance path configured to receive a sheet discharged out of the image forming apparatus and to convey the sheet toward the downstream apparatus; a second conveyance path branched from the first conveyance path, extended below the first conveyance path, and merged with the first conveyance path; a measuring portion disposed on the second conveyance path and configured to measure a test image on the sheet; a third conveyance path provided above the first conveyance path and configured to convey the sheet from which the test image has been measured by the measuring portion in the second conveyance path; and a sheet stacking portion which is provided above the first conveyance path and on which the sheet discharged out of the third conveyance path is stacked, and wherein the image forming condition of the image forming apparatus is changed in accordance with a measurement result of the measurement apparatus.

According to still another aspect of the invention, an image forming apparatus includes: an image forming unit forming an image on a sheet; a first conveyance path configured to receive a sheet on which an image is formed by the image forming unit and to convey the sheet toward a downstream apparatus connected with and disposed downstream of the image forming apparatus; a second conveyance path branched from the first conveyance path, extended below the first conveyance path, and merged with the first conveyance path; a measuring portion disposed on the second conveyance path and configured to measure a test image on the sheet; a third conveyance path provided above the first conveyance path and configured to convey the sheet from which the test image has been measured by the measuring portion in the second conveyance path; and a sheet stacking portion which is provided above the first conveyance path and on which the sheet discharged out of the third conveyance path is stacked.

Further features of the present invention will become apparent from the following description of exemplary embodiments with reference to the attached drawings.

BRIEF DESCRIPTION OF THE DRAWINGS

FIG. 5 illustrates a data structure of an ICC profile.

FIG. 9 illustrates contents of a sheet library.

FIG. 10A is a presentation screen of the sheet library.

FIG. 10B is a picture of a select screen for selecting a parameter correcting method.

DESCRIPTION OF THE EMBODIMENTS

Now, exemplary embodiments of the present invention will be described with reference to the drawings.

Figure 1:
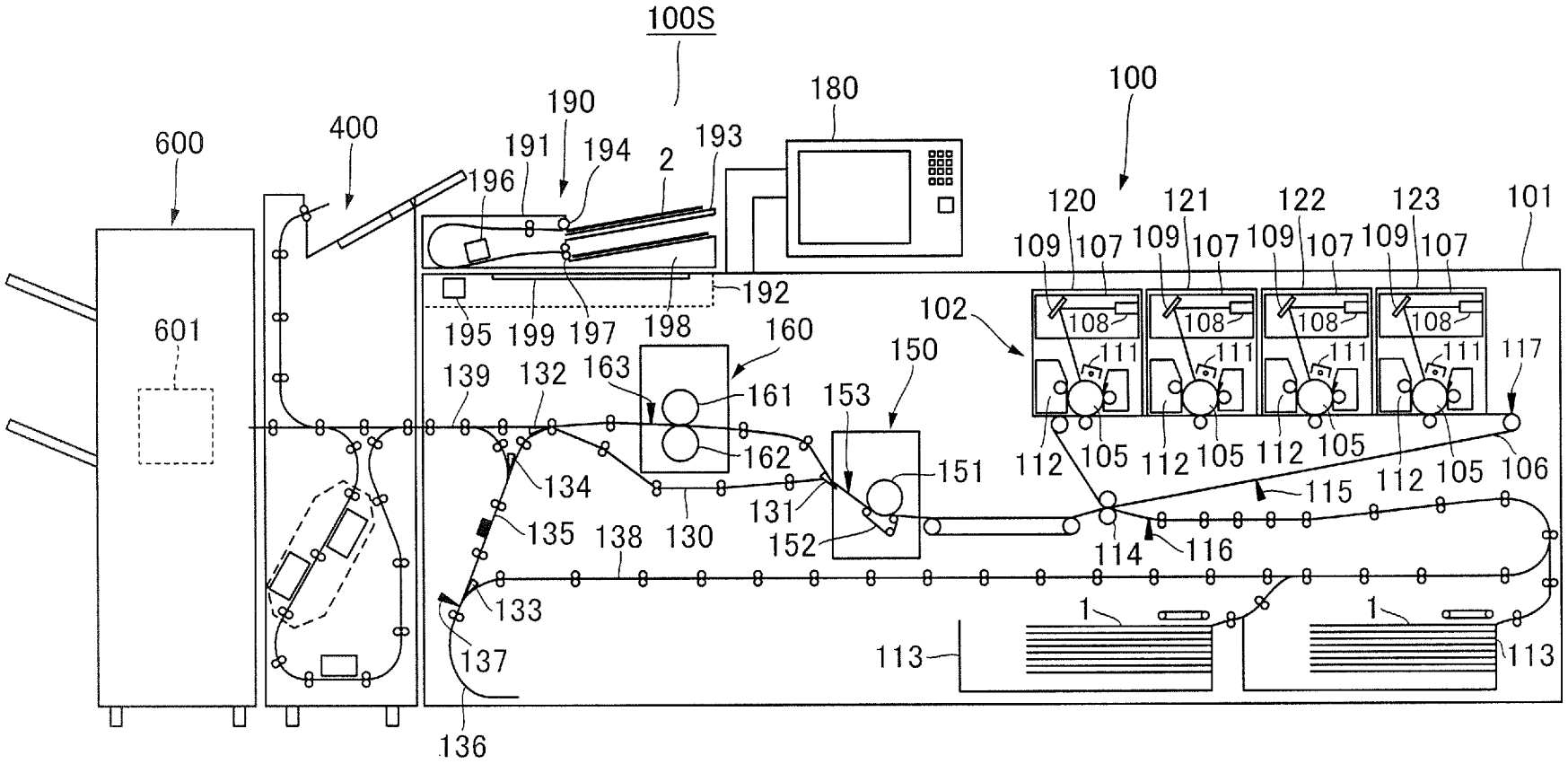
FIG. 1 is a schematic diagram illustrating a configuration of an image forming system according to an embodiment of the present disclosure.

FIG. 1 is a schematic diagram illustrating an image forming system 100S of the present embodiment. The image forming system 100S includes an image forming apparatus 100, an adjustment unit 400 and a finisher 600. The image forming apparatus 100 is an image forming apparatus of the present embodiment, the adjustment unit 400 is a measurement apparatus of the present embodiment and the finisher 600 is a sheet processing apparatus of the present embodiment.

Within a casing 101 of the image forming apparatus 100, an image forming engine 102 serving as an image forming unit, and a control board storage portion storing a printer controller 103 are mounted. The printer controller 103, which will be described later, controls operations of the image forming system 100S including the image forming apparatus 100. The image forming engine 102 of the present embodiment includes an optical process unit and a fixing process unit for forming an image on recording medium through an electrophotographic process and a feed process unit and a conveyance process unit feeding and conveying a sheet 1 used as recording medium. The sheet that may be used as recording medium includes a sheet such as a plain paper, a thick paper, a surface treated sheet such as a coated sheet or an embossed sheet and a sheet material such as a plastic film or cloth.

The optical process unit includes stations 120, 121, 122 and 123 configured to prepare toner images of respective colors of yellow, magenta, cyan and black and an intermediate transfer belt 106. In each of the stations 120 through 123, a primary charging unit 111 electrically charges a surface of a photosensitive drum 105 which is a drum-like photoconductor. A laser scanner portion 107 performs an exposure process of the photosensitive drum 105 based on a command signal generated based on image data and transmitted to the laser scanner portion 107. The laser scanner portion 107 includes a laser driver not illustrated and driving a laser beam radiated from a semiconductor laser ON and OFF and leads the laser beam from the semiconductor laser to the photosensitive drum 105 through a reflection mirror 109 while allocating in a main scanning direction by a rotational polygonal mirror. Thereby, an elastic latent image corresponding to the image data is formed on the surface of the photosensitive drum 105.

A developing unit 112 stores developing agent containing toner therein and supplies charged toner particles to the photosensitive drum 105. The electrostatic latent image borne on the photosensitive drum 105 is visualized as a toner image with the toner particles adhering to the surface of the drum in accordance with a surface potential distribution. The toner image borne on the photosensitive drum 105 is transferred, i.e., primarily transferred, onto the intermediate transfer belt 106 to which voltage of a polarity inverse to a normal electrification polarity of the toner is applied. A full color toner image is formed on the belt by transferring the toner images formed by the four stations 120 through 123 so as to overlap with each other. Meanwhile the feed process unit feeds sheets 1 one by one from a storage cabinet 113 drawably inserted into the casing 101 of the image forming apparatus 100 toward a transfer roller 114. The toner image borne on the intermediate transfer belt 106 serving as an intermediate transfer body is transferred, i.e., secondarily transferred, onto the sheet 1 by a transfer roller 114.

Around the intermediate transfer belt 106, an image formation start position detecting sensor 115 for determining a print start position in forming an image, a feed timing sensor 116 for measuring a timing for feeding the sheet 1, and a concentration sensor 117 are disposed. The concentration sensor 117 measures concentration of a patch image borne on the intermediate transfer belt 106. A printer controller adjusts operating conditions for the optical process unit, e.g., setting of a target charging potential of the primary charging unit 111 and the bias voltage of the developing unit 112, based on the detection results of the concentration sensor 117.

The fixing process unit of the present embodiment is composed of a first fixing unit 150 and a second fixing unit 160. The first fixing unit 150 includes a fixing roller 151 for applying heat to the sheet 1, a pressure belt 152 for bringing the sheet 1 to come into pressure contact with the fixing roller 151 and a first post-fixing sensor 153 for detecting completion of the fixing process by the first fixing unit 150. The fixing roller 151 is a hollow roller and includes a heater therein. The first fixing unit 150 applies heat and pressure to the toner image on the sheet 1 while nipping and conveying the sheet 1 between the fixing roller 151 and the pressure belt 152 serving as a rotary member pair. Thereby, the toner image is fixed to the sheet 1 as the toner particles melt and then adhere to the sheet 1.

The second fixing unit 160 is disposed downstream of the first fixing unit 150 in a conveyance path of the sheet 1. The second fixing unit 160 has a function of enhancing glossiness of the image on which the fixing process has been performed by the first fixing unit 150 and of assuring fixity of the image onto the sheet 1. Similarly to the first fixing unit 150, the second fixing unit 160 includes a fixing roller 161 and a pressure roller 162 serving as a rotary member pair configured to apply heat and pressure while conveying the sheet 1 and a second post-fixing sensor 163 detecting completion of the fixing process of the second fixing unit 160.

Note that there is a case where it is not necessary to pass the sheet 1 through the second fixing unit 160 depending on a type of the sheet 1. In order for that, the image forming apparatus 100 includes a bypass conveyance path 130 to discharge the sheet 1 without passing through the second fixing unit 160 to reduce energy consumption. The sheet 1 delivered out of the first fixing unit 150 is guided to either the second fixing unit 160 or the bypass conveyance path 130 by the first switching flap 131.

The sheet 1 that has passed through the second fixing unit 160 or the bypass conveyance path 130 is guided to either a discharge conveyance path 139 or a reverse conveyance path 135 by a second switching flap 132. A position of the sheet 1 conveyed into the reverse conveyance path 135 is detected by a reversal sensor 137 to invert leading and trailing edges of the sheet in terms of a sheet conveyance direction by a switchback operation performed by a reverse portion 136. In a case of duplex printing, the sheet 1 in which an image has been formed on a first surface thereof is conveyed again toward the transfer roller 114 through a re-conveyance path 138 in a condition in which the leading and trailing edges are switched by the reverse portion 136 to form an image on a second surface thereof. The sheet 1 onto which the image has been formed in a single-side printing or the sheet 1 in which the image has been formed on a second surface in the duplex printing is discharged out of the image forming apparatus 100 through a discharge conveyance path 139. Note that a switching flap 134 capable of guiding the sheet 1 switched back by the reverse portion 136 toward the discharge conveyance path 139 is provided between the reverse conveyance path 135 and the discharge conveyance path 139, so that whether a front surface or a back surface of the sheet 1 becomes apparent in discharging the sheet 1 out of the image forming apparatus can be selected.

On the top portion of the image forming apparatus 100, an image reading apparatus 190 including a body portion 192 fixed on the casing 101 of the image forming apparatus 100 and an automatic document feeder (referred to as an 'ADF' hereinafter) 191 are provided. The ADF 191 includes a feed tray 193 onto which a sheet 2 to be read as a document and a sheet discharge tray 198 to which the sheet 2 from which image information has been read is discharged. The sheet 2 set on the feed tray 193 is fed one by one by a sheet feed unit 194 such that the image information is optically scanned and is read by image sensors 195 and 196. In the illustrated example, the image sensor 195 reading the image information from one surface of the sheet 2 is disposed in the body portion 192 and the image sensor 196 reading the image information from another surface of the sheet 2 is provided at a lower part of the image reading apparatus 190. The sheet 2 from which the image information has been read is discharged by a discharge roller 197 to the sheet discharge tray 198.

Note that a document table 199 is provided at a position facing a lower surface of the ADF 191 to be able to read image information from a surface of an object to be read and laid on the document table 199 by moving the image sensor 195. Accordingly, the ADF 191 is connected with the casing 101 of the image forming apparatus 100 through a hinge and is configured to be openable upward from the document table 199.

Figure 3:
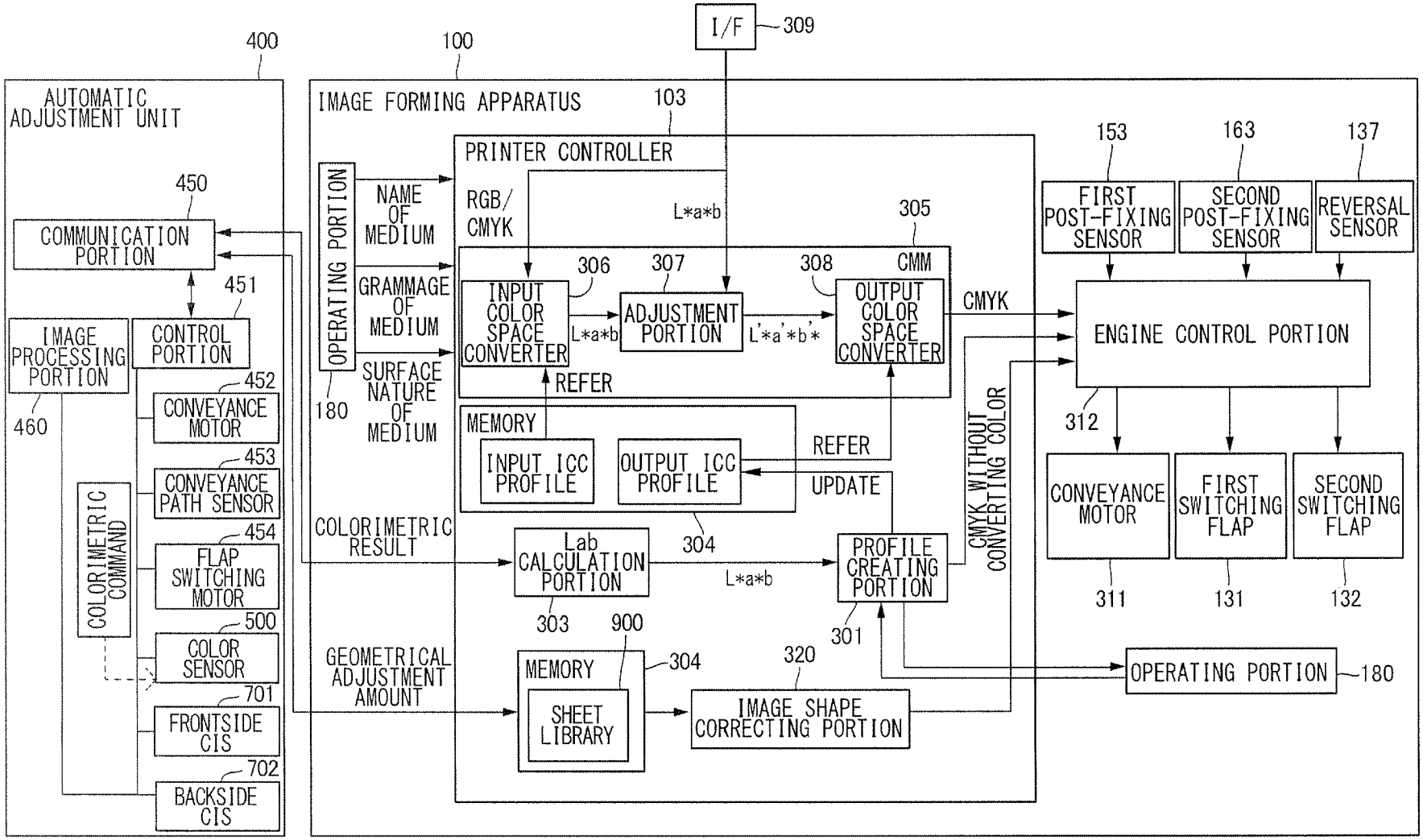
FIG. 3 is a block diagram illustrating a control configuration of the image forming system.

As illustrated in FIG. 3, the image forming apparatus 100 includes a printer controller 103 serving as a control portion for integrally controlling operations of the image forming system 100S. The printer controller 103 is a control board on which at least one processor and a memory 304 are mounted. The memory 304 includes a transitory and a non-transitory storage medium serving as a storage space of programs and data and as a work space when the processor executes the program. The printer controller 103 also includes a functional portion for exhibiting functions described below, e.g., a profile creating portion 301 and a color management module (CMM) 305. These functional portions may be mounted individually as independent hardware such as ASIC or may be mounted as software as a functional module of a program executed by a central processing unit (CPU) of the printer controller 103.

An engine control portion 312 causes an image forming engine 102 to perform the abovementioned image forming operation based on a command signal from the printer controller 103 to form an image onto the sheet. For instance, the engine control portion 312 controls operations of a conveyance motor 311 for driving the roller for conveying the sheet, a first switching flap 131 and a second switching flap 132 based on detection signals of the first post-fixing sensor 153, the second post-fixing sensor 163 and the reversal sensor 137.

The image forming apparatus 100 is provided with an operating portion 180 serving as a user interface of the image forming system 100S (see also FIG. 1). The operating portion 180 includes a display serving as a display portion for presenting information for the user. The operating portion 180 is also provided with, as an input portion by which the user can input commands and data to the image forming system 100S, physical keys such as a ten-key pad and a print execute button and a touch panel function of the display. Through the operation of the operating portion 180, the user can input information indicating attributes such as a name, grammage and whether a surface is treated of the sheet set in a certain storage cabinet 113 into the printer controller 103. The sheet attributes thus inputted are registered in a sheet library 900 stored in a memory 304.

The printer controller 103 is connected with an external wired or wireless communication network through an external interface (I/F) 309 and is communicable with an external computer. The printer controller 103 is also connected with control circuits of the units constituting the image forming system 100S, e.g., the adjustment unit 400 and the finisher 600 in the present embodiment. The printer controller 103 communicates with these units to coordinate operations of the image forming apparatus 100 and the respective units. Note that a control configuration of the adjustment unit 400 will be described later.

Adjustment Unit

The adjustment unit 400 serving as a measurement apparatus of the present embodiment will now be described. In the image forming system 100S illustrated in FIG. 1, the adjustment unit 400 is provided horizontally, i.e., laterally in FIG. 1, between the image forming apparatus 100 and the finisher 600. That is, an upstream unit of the adjustment unit 400 is the image forming apparatus 100 and a downstream apparatus of the adjustment unit 400 is the finisher 600. The finisher 600 includes a processing portion 601 configured to perform such processes as a binding process and a saddle process and discharges a processed sheet bundle as a printed product of the image forming system 100S or a sheet received from the upstream unit in a case where no process is necessary.

It is noted that the units connected upstream and downstream of the adjustment unit 400 vary depending on the configuration of the image forming system 100S. For instance, the adjustment unit 400 is not always directly connected with the image forming apparatus 100 and may be configured such that an intermediate unit is disposed between the image forming apparatus 100 and the adjustment unit 400 and that the adjustment unit 400 receives the sheet from the intermediate unit. An example of such intermediate unit includes a unit performing a coating process of applying glossiness to a surface of an image formed on the sheet by applying transparent toner. There is also a case where a sheet processing unit other than the finisher 600 is connected with and disposed downstream of the adjustment unit 400. Examples of such sheet processing units include an inserter of inserting a front cover sheet into a sheet bundle, a trimmer uniformly cutting an edge of a bundled sheet bundle and a stacker capable of moving a large amount of printed products while storing in a bogie.

Figure 2:
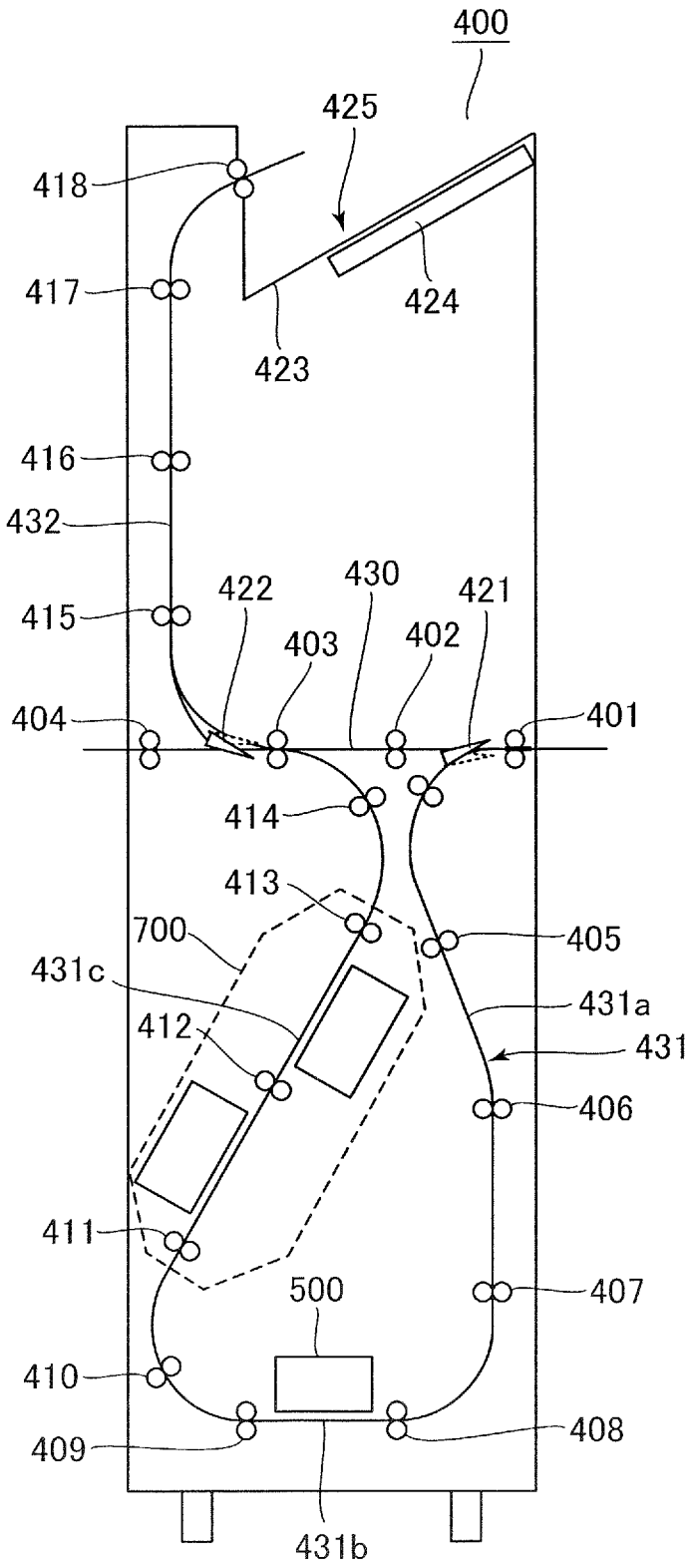
FIG. 2 is a schematic diagram of an adjustment unit.

As illustrated in FIG. 2, the adjustment unit 400 includes a color sensor 500 and a double-sides registration portion 700, each of which is an example of a measuring portion, a through path 430, a detection path 431 and a discharge path 432 constituting sheet conveyance paths within the adjustment unit 400. The through path 430 serves as a first conveyance path of the present embodiment, the detection path 431 serves as a second conveyance path of the present embodiment and the discharge path 432 serves as a third conveyance path of the present embodiment. The adjustment unit 400 also includes a discharged-sheet stacking portion 425 having a fixed tray 423 constituting a part of an upper surface of a casing of the adjustment unit 400 and an extension tray 424 which can be pulled out of the fixed tray 423. The discharged-sheet stacking portion 425 serves as a sheet stacking portion of the present embodiment, the fixed tray 423 serves as a first tray of the present embodiment and the extension tray 424 serves as a second tray of the present embodiment.

The through path 430 is a conveyance path extending approximately horizontally to receive the sheet discharged out of the image forming apparatus and to convey toward the finisher. Disposed on the through path 430 upstream to downstream in the sheet conveyance direction are a first roller 401, a second roller 402, a third roller 403 and a fourth roller 404 in this order.

The detection path 431 is a path on which the color sensor 500 and the double-sides registration portion 700 are disposed as described later and is formed so as to bypass under the through path 430. That is, the detection path 431 includes a descending portion 431*a* branched from the through path 430 and extending downward, a horizontal portion 431*b* extending approximately in a horizontal direction and an ascending portion 431*c* extending upward from the horizontal portion 431*b* and merging with 430. Accordingly, the detection path 431 communicates with the through path 430 at two places of a branch portion 441 where the detection path 431 branches from the through path 430 between the first roller 401 and the second roller 402 and a merging portion 442 where the detection path 431 merges with the through path 430 upstream of the third roller 403. Disposed on the branch portion 441 where the detection path 431 branches from the through path 430 is a first flap 421 serving as a first guide member by which the sheet conveyance route can be switched between the through path 430 and the detection path 431. Disposed along the detection path 431 at a plurality of positions along the sheet conveyance direction are conveyance rollers 405 through 414 for conveying the sheet.

The color sensor 500 and the double-sides registration portion 700 are disposed along the horizontal portion 431*b* and the ascending portion 431*c* that respectively extend straightly when seen from a width direction of the sheet. The ascending portion 431*c* is inclined such that the further the ascending portion 431*c* advances upward, the farther from a side surface on a finisher side (on a left side in FIG. 2) of the adjustment unit 400 to assure the straight section as much as possible.

The discharge path 432 is a conveyance path for discharging the sheet to a discharge space provided on the adjustment unit 400. The discharge path 432 branches from the through path 430 downstream of the third roller 403 and extends upward approximately vertically in the gravity direction from the through path 430. Disposed on a branch portion 443 where the discharge path 432 branches from the through path 430 is a second flap 422 serving as a second guide member which can switch the sheet conveyance route (discharge route) between the through path 430 and the discharge path 432. The sheet conveyed into the discharge path 432 is conveyed upward by conveyance rollers 415, 416 and 417 disposed along the discharge path 432 in order from a lower part to an upper part of the discharge path 432. A sheet discharge roller 418 provided at a downstream most part, i.e., a top, of the discharge path 432 discharges the sheet out of the adjustment unit 400 and loads it on the discharged-sheet stacking portion 425.

As illustrated in FIG. 3, an operation of the adjustment unit 400 is controlled by a control portion 451 mounted in the adjustment unit 400. Based on a detection signal of a conveyance path sensor 453 disposed along each conveyance path within the adjustment unit 400, the control portion 451 controls an operation of a conveyance motor 452 driving the conveyance roller and of a flap switching motor 454 switching positions of the first flap 421 and the second flap 422. The control portion 451 also instructs the color sensor 500 and the image sensors (701 and 702) of the double-sides registration portion 700 to execute measurement based on the instruction received from the printer controller 103 of the image forming apparatus 100 through a communication portion 450. Measurement results of the color sensor 500 or the image sensors (701 and 702) are transmitted to the printer controller 103 through the communication portion 450 after carrying out an image processing as necessary by an image processing unit 460.

1. Color Sensor

Figure 4:
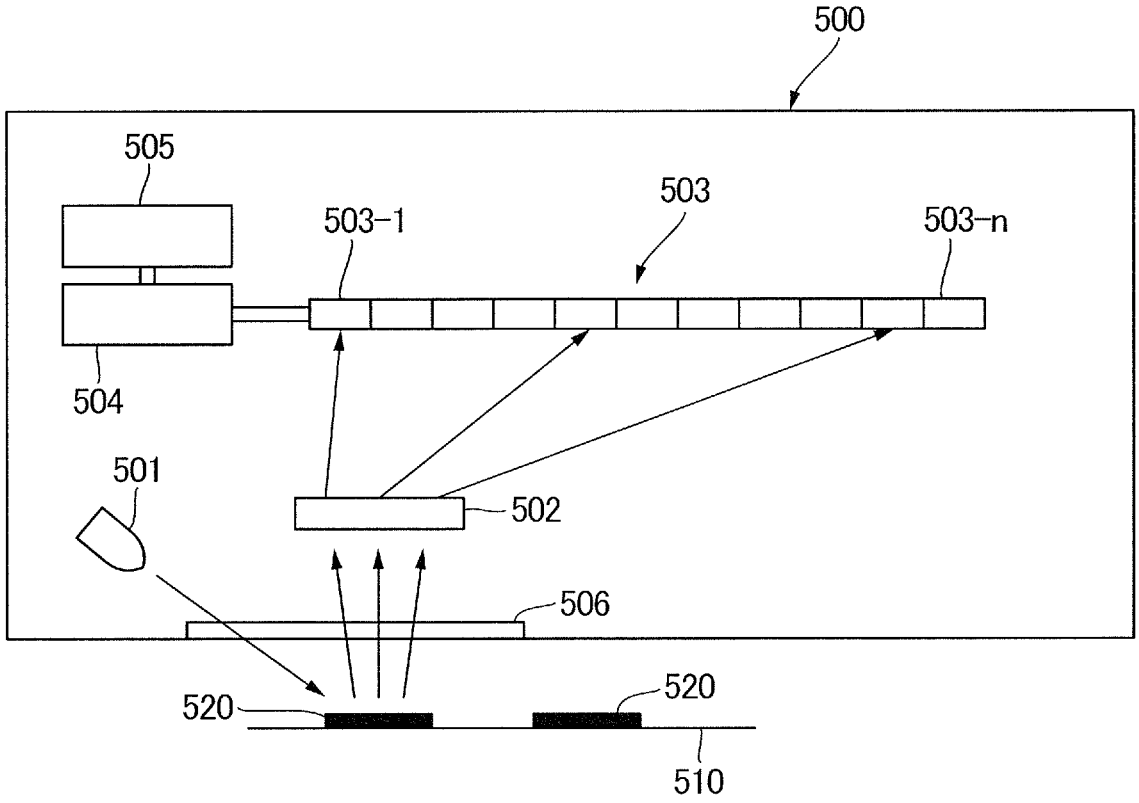
FIG. 4 is a schematic diagram of a color sensor.

A structure of the color sensor 500 serving as a first measuring portion of the adjustment unit 400 and a color management made by using the color sensor 500 will be described below. FIG. 4 is a schematic diagram illustrating the color sensor 500 of the present embodiment. The color sensor 500 includes a white LED 501 serving as a light source, a line sensor 503 detecting intensity of light and an optical system illuminating the sheet with the light of the light source and guiding a reflection light from the sheet to the line sensor 503. The white LED 501 illuminates the patch image 520 on the sheet with light having continuous spectrum. The diffraction grating 502 disperses the light reflected by the patch image 520 per wavelength. The line sensor 503 is composed of n pixels of image sensors 503-1, 503-2 and 503-*n* and measures intensity per wavelength of the light decomposed by the diffraction grating 502.

A wavelength region detectable by the line sensor 503 encompasses substantially an entire range of the visible light and is set as a region from 380 nm to 720 nm for example. CMOS sensors may be also utilized as the image sensors 503-1, 503-2 and 503-*n* of the line sensor 503. Note that in the structural example in FIG. 4, a lens 506 condensing the reflection light from the patch image 520 to the diffraction grating 502 is disposed.

A detection signal from the line sensor 503 is processed by a calculation unit 504 mounted in the color sensor 500, and a calculation result is stored in a memory 505. The calculation unit 504 includes a spectral calculator for example that performs spectrum calculation to calculate spectral reflectance of each patch image 520 based on light intensity values.

Color Management System

A method for managing colors feeds back measurement results of the color sensor 500 to the image forming apparatus 100. Assume that the present embodiment uses an ICC (International Color Consortium) profile which is lately accepted in the market as a profile that realizes excellent color reproducibility. However, another color management system may be adopted instead of the ICC profile. For instance, it is possible to use CRD (Color Rendering Dictionary) adopted in PostScript (registered trademark) advocated by Adobe Co. and a color separation table mounted in Adobe Photoshop (registered trademark). It is also possible to use a CMYK simulation which is a function of ColorWise (registered trademark) of EFI Co. maintaining black print information.

Figure 6:
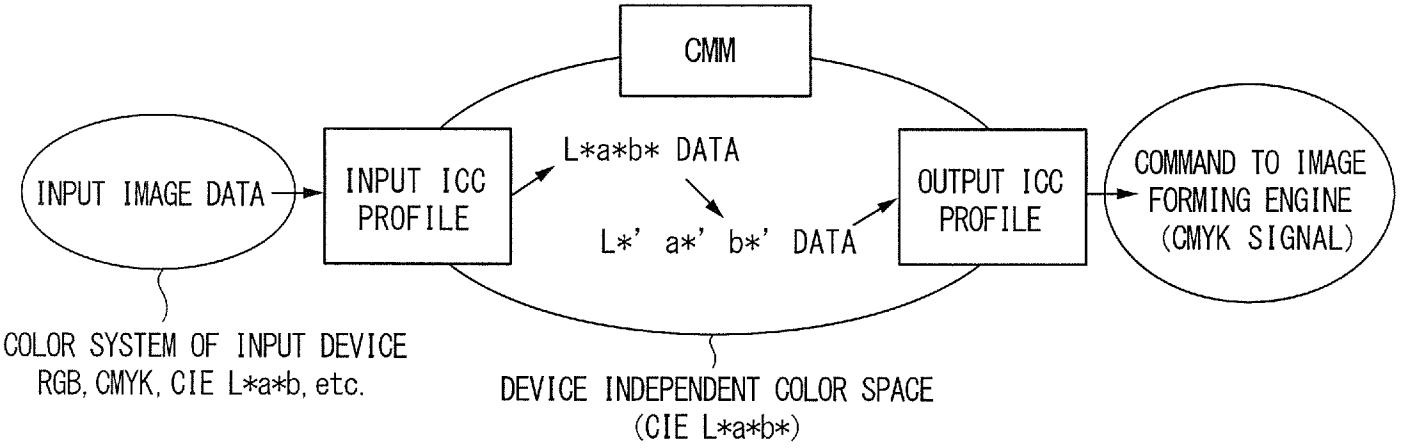
FIG. 6 is a conceptual diagram illustrating a role of a color management module.

FIG. 6 is a conceptual diagram illustrating the color management by CMM (color management module). Image data inputted to the image forming apparatus 100 does not always adopt rendering of colors in an L*a*b* color space and may be rendered by various data format (color system) such as RGB, CMYK, CIE and XYZ. There is also a case where a perceived color of an original image to be reproduced by the image forming apparatus 100 is different even among image data having common data format depending on characteristics of an input device, e.g., by gamma value of a monitor and setting of color temperature.

Due to that, the CMM once converts input image data into L*a*b* data rendered by a color space independent of a device (CIE L*a*b* color space in the present embodiment). Then, the CMM generates a command, i.e., the CMYK signal, for causing the image forming engines to form an image from the L*'a*'b*' data obtained by executing necessary correction to the L*a*b* data. In this process, an input ICC profile is used for the conversion from the color system of the input device to the L*a*b* color space. Still further, an output ICC profile is used for the conversion from the L*a*b* color space to the color space, i.e., a space of values from which the CMYK signal may take, handled by the image forming engine. Note that while the CIE L*a*b* is adopted as the device independent color space in the present embodiment, another color space other than that, e.g., CIE1931 XYZ color space, may be adopted.

Note that the CMYK signal is what designates a level of exposure caused by the laser scanner portion 107 of each of the stations 120 through 123 of yellow, magenta, cyan and black. That is, the value of the CMYK signal corresponds to toner concentration level per every pixel of a monochromic image formed by each of the stations 120 through 123. The CMYK signal is transmitted from the printer controller 103 to the engine control portion 312 and is then inputted to the laser scanner portion 107 as a video signal.

Measurement by Color Sensor

Because the image forming system 100S of the present embodiment includes the adjustment unit 400 with the color sensor 500, the system 100S can prepare own output ICC profile. The output ICC profile is a color conversion profile indicating a correspondence between the CMYK signal inputted to the image forming engine 102 and a color of an image actually formed on the sheet by the image forming engine 102.

In creating the output ICC profile of the image forming apparatus 100, patch images are formed on a sheet in a pattern designated in advance in the image forming apparatus 100 to make a colorimetric image pattern on the sheet at first. The sheet on which the image pattern has been formed is sent to the adjustment unit 400 to measure spectral reflectance by the color sensor 500. That is, the light irradiated from the white LED 501 described above and is reflected by one of the patch images in the image pattern, and the reflected light is dispersed by the diffractive grating 502. Then, the line sensor 503 measures intensity of light per wavelength.

Specification of Color Space Coordinates of Patch Image

Next, a method for calculating coordinates representing a color of each patch image in the device independent color space, i.e., the L*a*b* color space defined by CIE here, from the spectral reflectance acquired with the color sensor 500 will be described. It is possible to calculate the coordinates of the L*a*b* color space from the spectral reflectance through a procedure conforming to ISO 13655 as described below for example.

(a) Find a spectral reflectance R(λ). (λ: 380 nm to 780 nm)

(b) Prepare a color-matching function x(λ), y(λ), z(λ) and a standard spectral distribution SD50(λ). Note that the color-matching function is provided in Japanese Industrial Standards JIS Z8701, which has been replaced with JIS Z 8781 based on ISO 11664. The SD50(λ) is provided in JIS Z8720 based on ISO 23603 and is called also as an auxiliary standard illuminant D50. Still further, although denotation with an over line is normally used for x(λ), y(λ), z(λ), the over line will be omitted in the following description.

(c) Multiply the spectral reflectance R(λ), the color-matching function x(λ), y(λ), z(λ) and the standard spectral distribution SD50(λ) per wavelength:

$R(\lambda)\times SD50(\lambda)\times x(\lambda)$ $R(\lambda)\times SD50(\lambda)\times y(\lambda)$ $R(\lambda)\times SD50(\lambda)\times z(\lambda)$ (d) Integrate the products of (c) across the entire wavelength region:

$\Sigma\{R(\lambda)\times SD50(\lambda)\times x(\lambda)\}$ $\Sigma\{R(\lambda)\times SD50(\lambda)\times y(\lambda)\}$ $\Sigma\{R(\lambda)\times SD50(\lambda)\times z(\lambda)\}$ (e) Find an integrated value of the product of the color-matching function y(λ) and the standard spectral distribution SD50(λ):

$\Sigma\{SD50(\lambda)\times y(\lambda)\}$ (f) Calculate coordinates in XYZ color spaces:

$$X=100\times\Sigma\{SD50(\lambda)\times y(\lambda)\}/\Sigma\{R(\lambda)\times SD50(\lambda)\times x(\lambda)\}$$

$$Y=100\times\Sigma\{SD50(\lambda)\times y(\lambda)\}/\Sigma\{R(\lambda)\times SD50(\lambda)\times y(\lambda)\}$$

$$Z=100\times\Sigma\{SD50(\lambda)\times y(\lambda)\}/\Sigma\{R(\lambda)\times SD50(\lambda)\times z(\lambda)\}$$

(g) Convert the XYZ coordinates obtained by (f) into the L*a*b* color space:

$$L^*=116\times(Y/Yn)\hat{}(1/3)-16$$

$$a^*=500\{(\lambda/Xn)\hat{}(1/3)-(Y/Yn)\hat{}(1/3)\}$$

$$b^*=200\{(Y/Yn)\hat{}(1/3)-(Z/Zn)\hat{}(1/3)\}$$

Xn, Yn and Zn in (g) described above are values representing coordinates of a standard white point (standard tristimulus values). Those described above are conversion equations when Y/Yn≥0.008856 and are substituted when Y/Yn<0.008856, as follows:

(λ/Xn)^(⅓)→7.78(λ/Xn)^(⅓)+16/116

(Y/Yn)^(⅓)→7.78(Y/Yn)^(⅓)+16/116

(Z/Zn)^(⅓)→7.78(Z/Zn)^(⅓)+16/116

Profile Creating Process

Next, contents of a profile creating process of creating the ICC profile by the image forming apparatus 100 will be described. It is possible to execute the profile creating process at any timing as the user explicitly instructs by operating through the operating portion 180. For instance, it is conceivable to execute the profile creating process in a case where a customer engineer replaces parts, before executing an image forming job by high color reproducibility is required or in a case where it is desirable to know color of a final output product in a design planning stage.

When an operation for creating the ICC profile is made to the operating portion 180 in FIG. 3, a signal instructing for creating the profile is inputted to a profile creating portion 301 of the printer controller 103. The profile creating portion 301 transmits a CMYK signal outputting a test form, i.e., a CMYK color chart, of 928 patches provided in ISO 12642 to an engine control portion 312 without making color conversion by the output ICC profile. That is, the test form provided in ISO 12642 is adopted in the present embodiment as an image pattern serving as a test image for color management. In parallel with the transmission of the CMYK signal, the profile creating portion 301 sends an instruction to the adjustment unit 400 to measure by using the color sensor 500.

The image forming apparatus 100 executes an image forming operation based on the CMYK signal inputted to the engine control portion 312 and forms the test form on a sheet. The sheet on which the test form has been formed is conveyed to the adjustment unit 400 to perform color measurement of the test form by the color sensor 500. The spectral reflectance data of each of the 928 patches measured by the color sensor 500 is notified to a Lab calculation unit 303 to convert into data of the L*a*b* color space.

The profile creating portion 301 creates the output ICC profile by correlating the CMYK signal transmitted to the engine control portion 312 with the colorimetric results of the color sensor 500. The profile creating portion 301 also substitutes the present output ICC profile stored in the memory 304 with a newly created output ICC profile.

The output ICC profile is constructed as illustrated in FIG. 5 for example and includes a header, a tag and its data. The profile creating portion 301 prepares a conversion table (A2Bx tag) of CMYK to L*a*b* based on the L*a*b* value obtained from the CMYK signal used in the output of the test form and the colorimetric results. Still further, based on this conversion table, an inverse conversion table (B2Ax tag) of L*a*b* to CMYK is prepared. Tags representing other data such as the white color point (wtpt) and a tag (gamt) describing whether a certain color is within or without of a color range of a hard copy outputted by the image forming apparatus 100 are also described in the output ICC profile.

Note that in a case where the instruction of executing the profile creating process is inputted through an external IX 309, the ICC profile created by the profile creating portion 301 may be transmitted to the external device that has sent the execution instruction. In this case, it is possible to arrange such the user performs the color conversion on the external device by an application corresponding to the ICC profile.

Note that as indexes of color matching precision and color stability, ΔE is provided to be 4.0 in average in the Color matching precision standard (IT8.7/4(ISO 12642: 1617 patches)[4.2.2]) described in ISO 12647-7. Still further, ΔE of each patch is provided to be 1.5 or less in Reproducibility [4.2.3] which is a standard of stability. Such detection precision of the color sensor 500, i.e., ΔE, is desirable to be 1.0 or less. However, ΔE is a parameter expressed by the following equation and means a three-dimensional distance between two points (L1, a1, b1) and (L2, a2, b2) within the L*a*b* color space:

$$\Delta E=\{(L1-L2)\hat{}2+(a1-a2)\hat{}2+(b1-b2)\hat{}2\}\hat{}(1/2)$$

Color Conversion Process

Next, a color conversion process to be performed on input image data in a case where an image forming job instructing to form an image is inputted to the image forming apparatus 100 will be described. In the block diagram illustrated in FIG. 3, the image data received by the printer controller 103 through the external IX 309 is inputted to the CMM 305. The image data is often rendered by standard printing CMYK signal values such as RGB values and Japan Color in normal color printing. In this case, an input color space converter 306 of the CMM 305 performs the color conversion of RGB to L*a*b* or CMYK to L*a*b by referring to the input ICC profile stored in the memory 304 to convert the input image data into the L*a*b* data. The input ICC profile is composed of one dimensional LUT (look up table) controlling gamma of an input signal, a multi-dimensional color LUT called as a direct mapping and one dimensional LUT controlling gamma of generated conversion data.

An adjustment portion 307 of the CMM 305 corrects the L*a*b* data as necessary to adjust color of a printed product. An example of the correction process includes GAMUT conversion correcting a mismatch between a color range of an input device and a color range reproducible by the image forming apparatus 100. Another example includes a case where color conversion of adjusting a mismatch between a type of light source for input and a type of light source in observing the printing product of the image forming apparatus 100 (referred to also as a mismatch in setting color temperature). A still other example includes a case where discrimination of black characters for discriminating character parts within a color image to convert to a color suitable as a color of characters in order to enhance readability of the characters in a printed product. The L*a*b* data is converted by these correcting processes into L*'a*'b*' data. The adjustment portion 307 of the CMM 305 converts into the L*'a*'b*' data by conducting the correcting process as necessary also in a case where input image data inputted through the external I/F 309 is rendered by the L*a*b* color space.

An output color space converter 308 of the CMM 305 converts the L*'a*'b*' data into the CMYK signal by conducting the color conversion of L*a*b* to CMYK by applying the output ICC profile stored in the memory 304.

In a case where the output ICC profile is updated by the profile creating portion 301 at this time, the CMYK signal generated in a condition before the update differs from the CMYK signal generated in a condition after the update even if the L*a*b* data is the same. That is, the output ICC profile as an image forming condition of the image forming apparatus 100 is changed in accordance with the measurement results of the adjustment unit 400 serving as the measuring portion of the present embodiment.

2. Double-Sides Registration Portion

Next, a configuration and an operation of a double-sides registration portion 700 (see FIG. 2) serving as a second measuring portion of the adjustment unit 400 will be described. The double-sides registration portion 700 measures a shape and a positional relationship of an image pattern on the sheet. Because it is necessary to average variations of the shapes and of image positions per every sheet in order to obtain a high precision measurement results, the measurement is conducted on a plurality of sheets. Therefore, a contact image sensor (CIS) is adopted as a sensor unit for conducting the measurement in the present embodiment. It becomes possible to conduct the measurement while conveying the sheet without moving the sensor unit and to shorten a time required for the measurement by using the CIS. It is also possible to downsize the apparatus by using the image sensor of an equal-magnification optical system as compared to a reduction optical system, i.e., a so-called CCD system.

Figure 7:
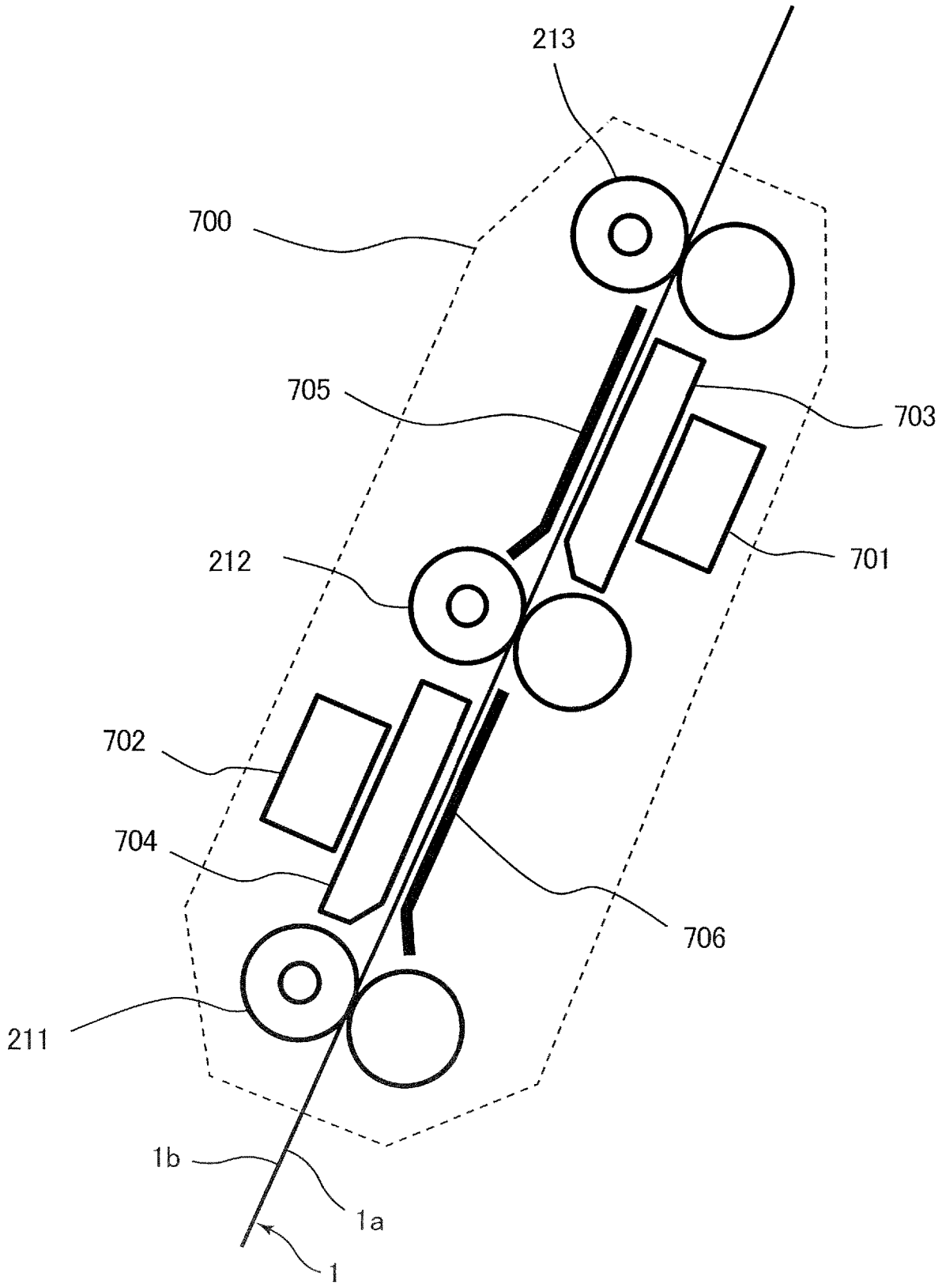
FIG. 7 is a schematic diagram of a double-sides registration portion.

As illustrated in FIG. 7, the double-sides registration portion 700 includes a frontside CIS 701 and a backside CIS 702. The frontside CIS 701 is a first image sensor that reads image information from a first surface 1*a* of the sheet 1 and the backside CIS 702 is a second image sensor that reads image information from a second surface 1*b* of the sheet 1, i.e., a surface opposite to the first surface 1*a*, at a position different from that of the first image sensor in terms of a sheet conveyance direction. The frontside CIS 701 and the backside CIS 702 are also disposed as close as possible, i.e., so as to be adjacent while interposing the conveyance roller 212 in the configuration illustrated in FIG. 7 to be able to approximately simultaneously read pattern images formed on the first surface 1*a* and the second surface 1*b* of the sheet 1.

The structure of the frontside CIS 701 is in common with that of the backside CIS 702. That is, each of the CISs 701 and 702 includes an LED array serving as a light source, a sensor array composed of image sensors such as CMOS and a plurality of lenses, i.e., a lens array, imaging light reflected from the sheet 1 to the sensor array. These LED array, sensor array and lens array are arrayed in a width direction across a whole range of length from which the CISs 701 and 702 can read image information in the width direction orthogonal a conveyance direction of the sheet 1 in the double-sides registering portion 700.

The sheet 1 that has arrived at the double-sides registration portion 700 passes through reading ranges of the backside CIS 702 and the frontside CIS 701, being conveyed by the conveyance rollers 211, 212 and 213. The reading range of the backside CIS 702 is a space between a transparent guide 704 and a black guide 706 and the reading range of the frontside CIS 701 is a space between a transparent guide 703 and a black guide 705. The black guides 705 and 706 are conveyance guides for guiding the sheet 1, are also members that become backgrounds when the CISs 701 and 702 scan the sheet 1 and are colored in black to clear contrast with the sheet 1. The transparent guides 703 and 704 face the black guides 705 and 706 with a predetermined gap to stabilize a position in a focus depth-wise direction of the sheet 1 in the reading ranges.

Feedback of Double-side Registration

Next, the measurement of the double-sides registration portion 700 and feedback of measurement results will be described. A sheet library 900 (see FIGS. 3 and 9) is what the printer controller 103 holds in the memory 304 and is data storing a list of sheets that can be used by the image forming apparatus 100 as recording media in association with attribute information such as lengths in sub-/main-scanning directions and grammage. Among information contained in the sheet library 900, geometric adjustment amounts 901 and 902 are parameters for correcting positions and shapes of images in executing an image forming operation by using the sheet.

As illustrated in FIG. 10A, the user can confirm the contents of the sheet library 900 by displaying a library presentation screen 1001 by manipulating the operating portion 180. The user can also display a select screen 1003 as illustrated in FIG. 10B for selecting a correction method by manipulating "Adjust Printing Position" button 1002 in the library presentation screen 1001. In a case where the user selects an option 1004 of "Manually Adjust", the user can directly specify values of the geometric adjustment amounts 901 and 902 by inputting numerical values by using a ten key or the like. Meanwhile, in a case where the user selects an option 1005 of "Adjust by Reading Test Page", the image forming apparatus 100 forms a pattern image for double-sides registration and the geometric adjustment amounts 901 and 902 are automatically adjusted as the double-sides registration portion 700 of the adjustment unit 400 measures the sheet.

Figure 8B:
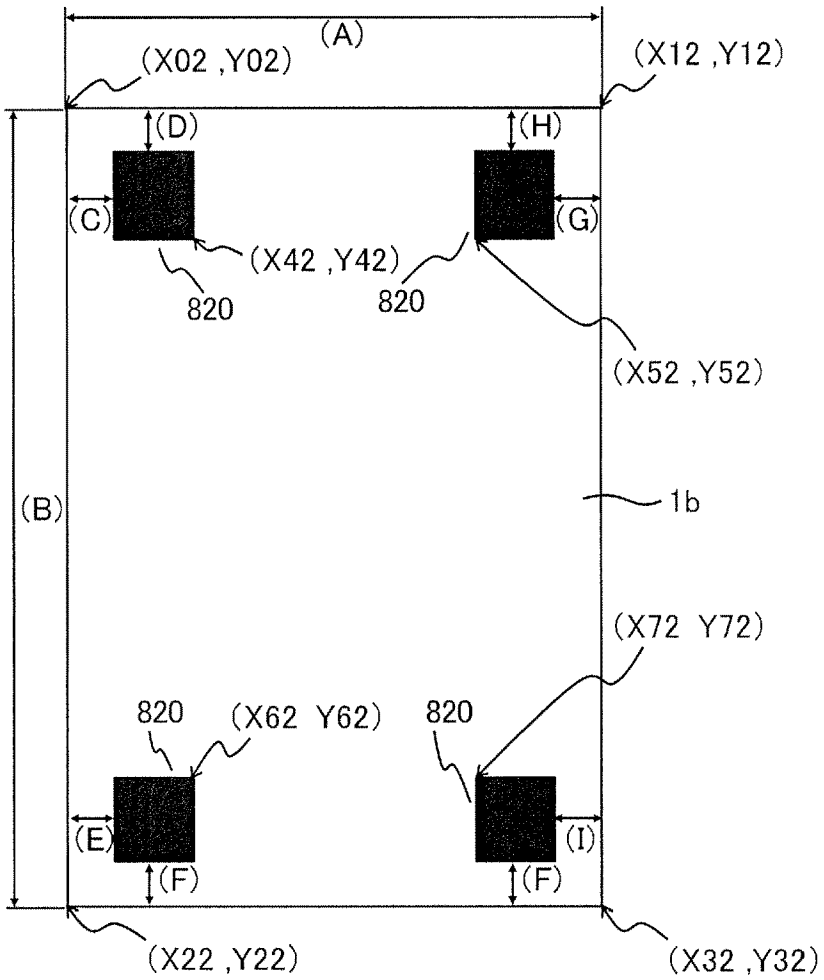
FIG. 8B is a schematic diagram illustrating another pattern image for registration of a backside.
Figure 8A:
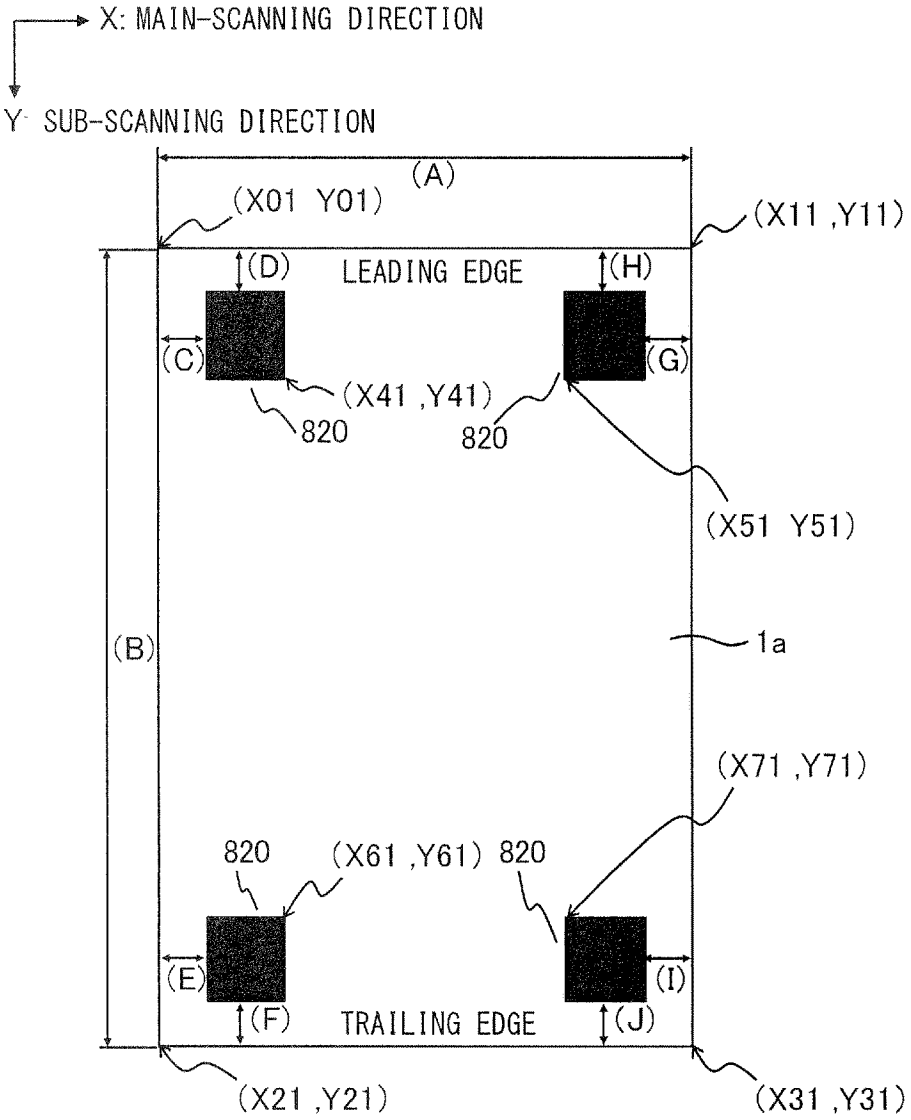
FIG. 8A is a schematic diagram illustrating a pattern image for registration of a frontside.

In a double-sides registration process of the present embodiment, test patterns 820 in which square patches are disposed around four corners of the sheet surface are formed on both sides of the sheet 1 as another example of the test image as illustrated in FIGS. 8A and 8B. The sheet 1 is fed from a sheet storage cabinet storing the sheet designated as an object of the double-sides registration process, the image forming engine 102 forms the test pattern 820 and then the sheet 1 is conveyed to the adjustment unit 400. The double-sides registration portion 700 of the adjustment unit 400 reads line images from the sheet 1 passing through the reading ranges by the CISs 701 and 702 while conveying the sheet 1 by the conveyance rollers 211, 212 and 213. Then, image data including the sheet 1 and the test pattern 820 on the sheet is combined by connecting the line images in the sub-scanning direction, i.e., in the conveyance direction of the sheet 1.

An image processing unit 460 (see FIG. 3) of the adjustment unit 400 detects a profile of the sheet 1 and the test pattern 820 from the combined image data and specifies corner coordinates of the sheet 1 and coordinates of the respective patches of the test pattern 820. The corner coordinates of the sheet 1 represent positions of the four corners of the sheet 1, i.e., $\{(X_{01}, Y_{01})\sim(X_{31}, Y_{31}), (X_{02}, Y_{02})\sim(X_{32}, Y_{32})\}$, where an X-axis is the main-scanning direction, i.e., a width direction of the sheet 1 and a Y-axis is the sub-scanning direction. The corner coordinates of the sheet 1 contain information regarding the shape of the sheet such as a length of a short edge (A) and a long edge (B) of the sheet and squareness of the corners. The coordinates of the test pattern 820 represent positions of specific regions of the pattern image in the same coordinate system with the coordinates of the corners, i.e., represent $\{(X_{41}, Y_{41})\sim(X_{71}, Y_{71}), (X_{42}, Y_{42})\sim(X_{72}, Y_{72})\}$. The coordinates of the test pattern 820 contain information regarding misregistration and distortion of the image with respect to the sheet.

The image processing unit 460 further calculates geometric adjustment amounts with respect to the sheet 1 by using the corner coordinates of the sheet 1 and the coordinates of the test pattern 820. Among the geometric adjustment amounts, a lead position is a parameter defining an image position in the sub-scanning direction and a side position is a parameter defining an image position in the main-scanning direction. A main scan magnification is a parameter defining magnification in enlarging or reducing the image data in the main-scanning direction, and a sub-scanning magnification is a parameter defining magnification in enlarging or reducing the image data in the sub-scanning direction. Suppose a case where the correction of the shape of the image is made for example, these parameters are determined such that distances from the test patterns 820 to edge portions of the sheet ("C" through "J" in FIGS. 8A and 8B) are equalized with a value set in advance.

Note that while the four parameters of the lead position, the side position, the main scan magnification and the sub-scan magnification are cited as the geometric adjustment amounts here, it is also possible to arrange the image processing unit 460 so as to calculate other parameters. For instance, it is conceivable to adopt a parameter for making trapezoidal correction on an image or a parameter for defining a rotation angle of an image.

The geometric adjustment amounts calculated by the image processing unit 460 are sent to the printer controller 103 of the image forming apparatus 100 through a communication portion 450 to be registered in the sheet library 900. In a case where the image forming apparatus 100 executes an image forming job, an image shape correcting portion 320 refers to the sheet library 900 to acquire sheet information 910, 911, 912 and so on (see FIG. 9) of a sheet designated as recording medium. Then, the image shape correcting portion 320 corrects the image data based on the geometric adjustment amounts 901 and 902 of the acquired sheet information. This arrangement makes it possible to reduce misregistration and distortion of an output image. That is, the geometric adjustment amounts 901 and 902 are examples of other image forming conditions changed based on the measurement results of the adjustment unit 400.

Note that while the case where the test pattern 820 for double-sides registration has been formed based on the explicit instruction made from the user has been described here, the test pattern 820 may be formed also in another case. For instance, in a case where an image forming job is inputted, it is also possible to arrange such that a test pattern 820 is formed to a same sheet with that designated in the job to acquire geometric adjustment amounts as a preliminary operation before executing the job. It is also possible to automatically insert a job of forming a test pattern 820 every time when a certain number of sheets of printed products are outputted to calibrate during execution of an image forming job requiring a large amount of printed products.

Control Method

Figure 11:
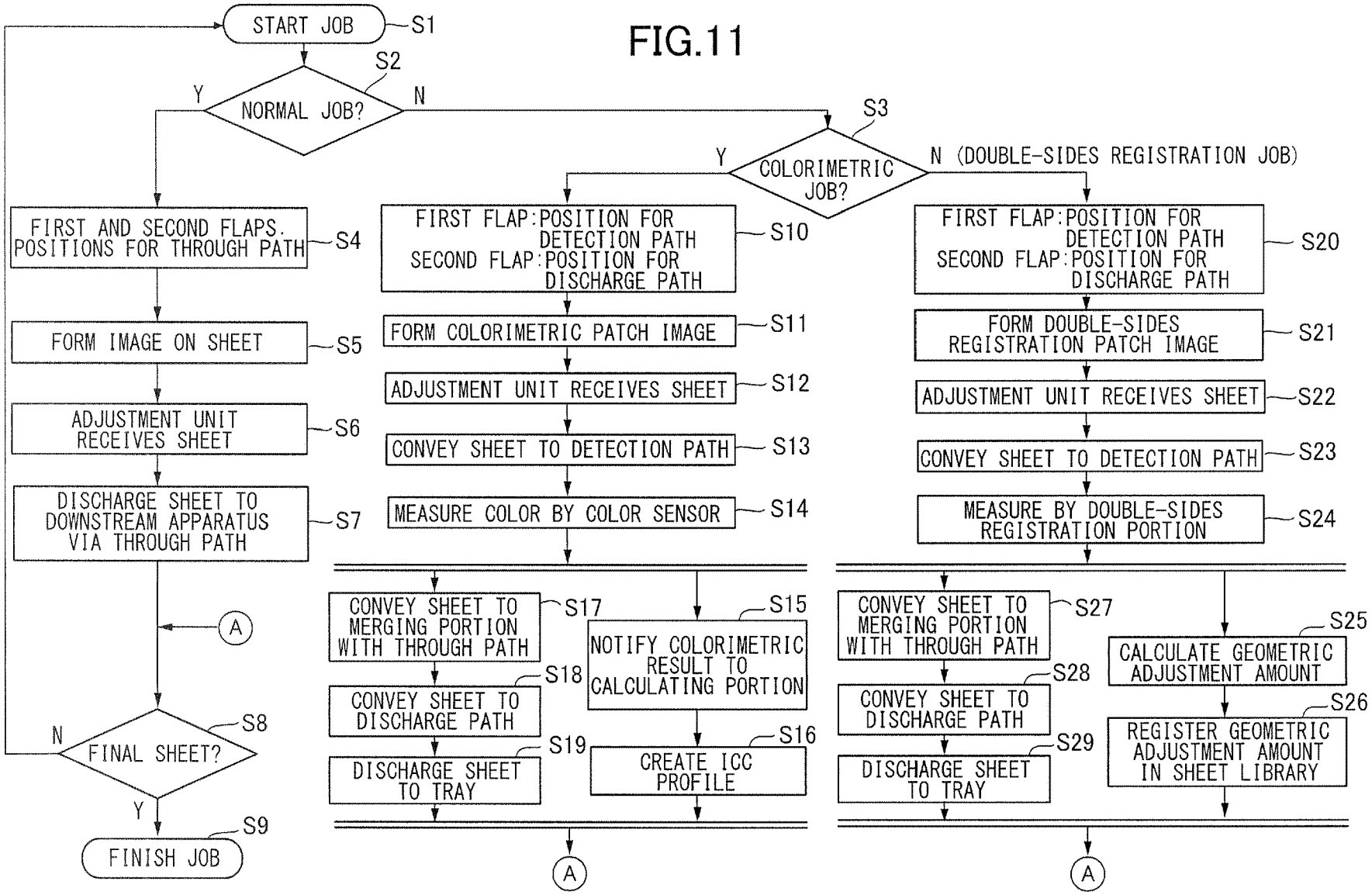
FIG. 11 is a flowchart showing an exemplary control method for the image forming system.

A control method of the sheet conveyance operation and the measurement operation of the adjustment unit 400 in the image forming system 100S constructed as described above will be described along a flowchart in FIG. 11 while making reference to the block diagram in FIG. 3.

Among image forming jobs, a job that requires an output of a printed product and that does not require the adjustment unit 400 to measure an image pattern, i.e., a test image, will be referred to as a "normal job" in the following description. A job by which the adjustment unit 400 measures an image pattern by the color sensor 500 to make color management will be referred to as a "colorimetric job". Still further, a job by which the adjustment unit 400 measures an image pattern by the CISs 701 and 702 of the double-sides registration portion 700 to conduct the double-sides registration will be referred to as a "double-sided registration job". Note that the normal job is inputted to the printer controller 103 in such cases where the normal job is inputted from an external computer through the external I/F 309 and the user instructs to start a copying operation through the operating portion 180. As for the colorimetric job and the double-sides registration job, there may be cases where they are executed by an explicit instruction of the user and where they are executed spontaneously by the image forming system 100S.

Figure 12A:
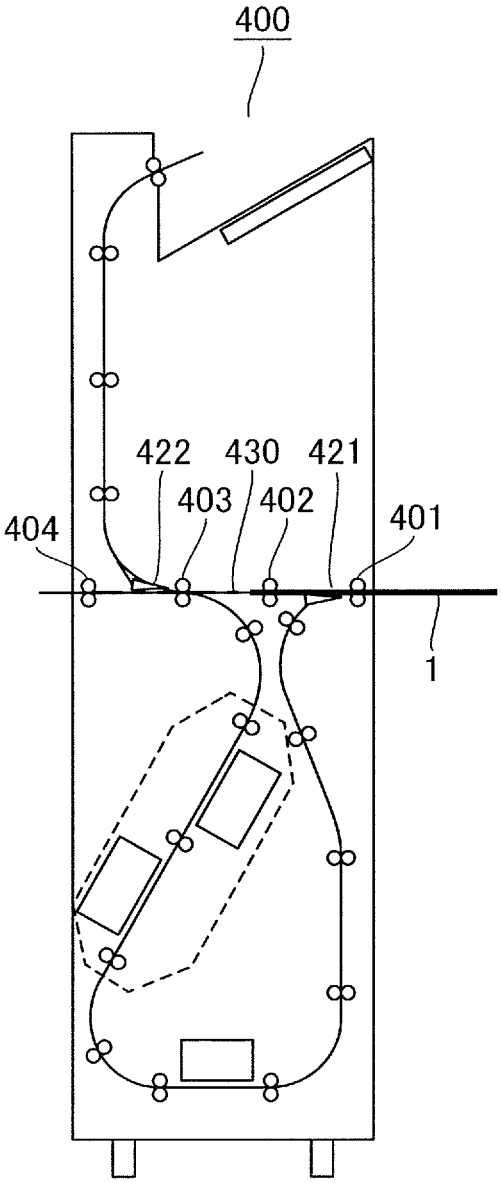
FIG. 12A is a schematic diagram illustrating a sheet conveyance operation in a normal job.

When starting the image forming job in Step S1, the printer controller 103 discriminates whether the job is the normal job, the colorimetric job or the double-sides registration job in Steps S2 and S3. In a case of the normal job, i.e., Yes in Step S2, members involved in conveyance of a sheet in the image forming apparatus 100 and the adjustment unit 400 wait at a default position, i.e., at home position. In the adjustment unit 400, both of the first flap 421 and the second flap 422 are positioned at positions of guiding the sheet to the through path 430 in Step S4. That is, as illustrated in FIG. 12A, the first flap 421 serving as a first guide member is held at a lower position, i.e., a position of guiding the sheet to the first conveyance path, and the second flap 422 serving as a second guide member is held at an upper position, i.e., a position of discharging the sheet through the first conveyance path.

Figure 12B:
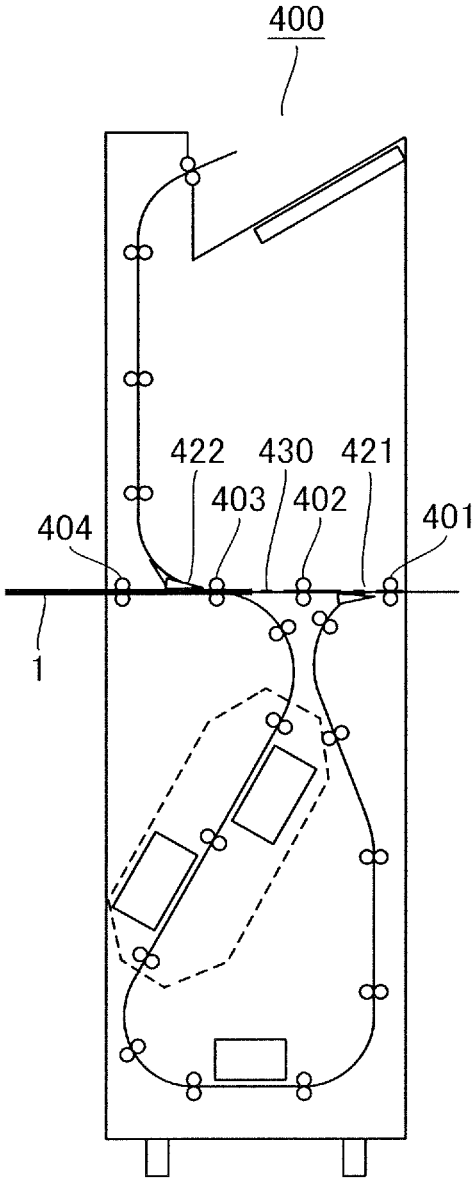
FIG. 12B is a schematic diagram illustrating the sheet conveyance operation in the normal job.

The image forming apparatus 100 forms an image on the sheet in accordance with image data required to be outputted by the image forming job in Step S5 and then the adjustment unit 400 receives the sheet in Step S6. Then, as illustrated in FIGS. 12A and 12B, the sheet 1 is delivered in order of the first roller 401 through a fourth roller 404 to pass through the through path 430. Then, the sheet 1 is discharged by the fourth roller 404 to the finisher 600 in Step S7 to be stacked as a printed product on a tray of the finisher 600.

Figure 13E:
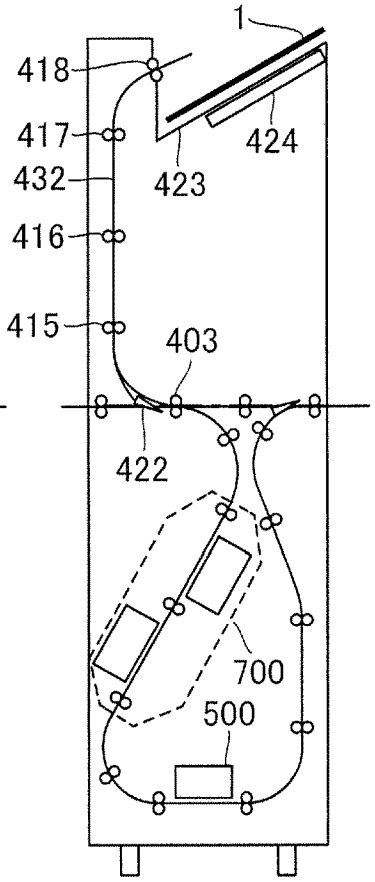
FIG. 13E is a schematic diagram illustrating the sheet conveyance operation in the colorimetric job and the double-sides registration job.
Figure 13D:
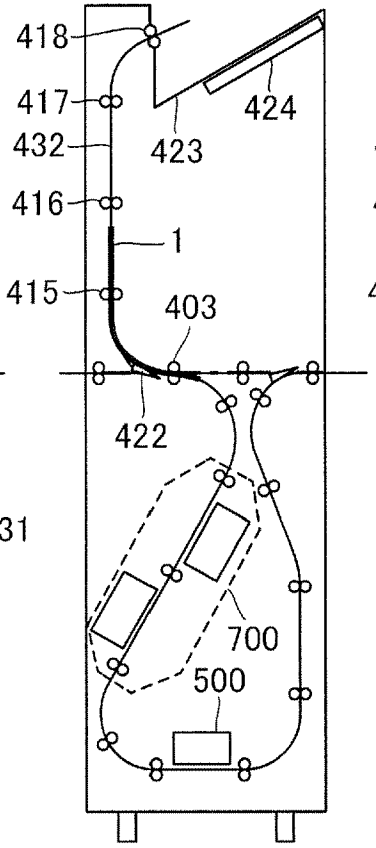
FIG. 13D is a schematic diagram illustrating the sheet conveyance operation in the colorimetric job and the double-sides registration job.
Figure 13C:
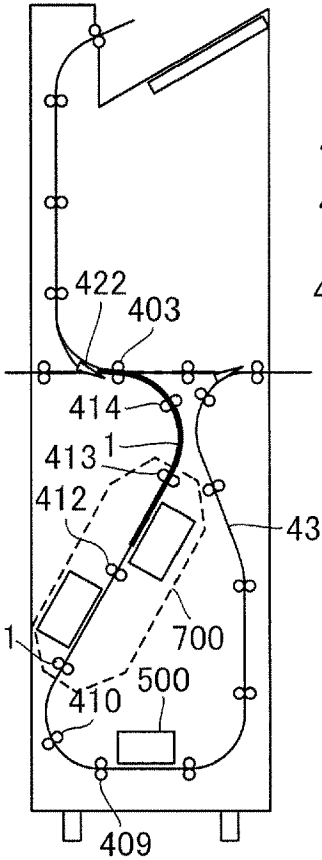
FIG. 13C is a schematic diagram illustrating the sheet conveyance operation in the colorimetric job and the double-sides registration job.
Figure 13B:
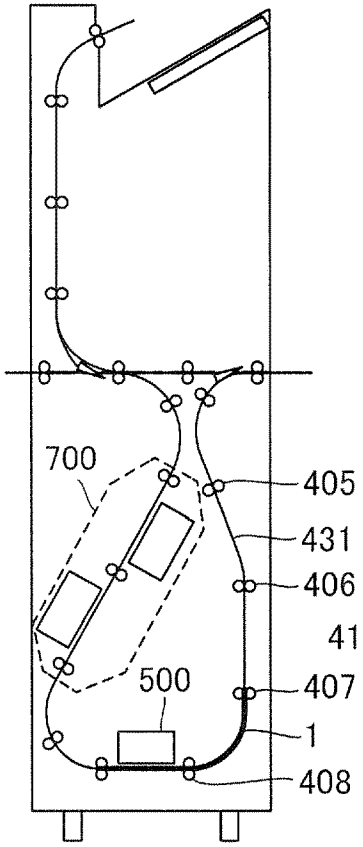
FIG. 13B is a schematic diagram illustrating the sheet conveyance operation in the colorimetric job and the double-sides registration job.
Figure 13A:
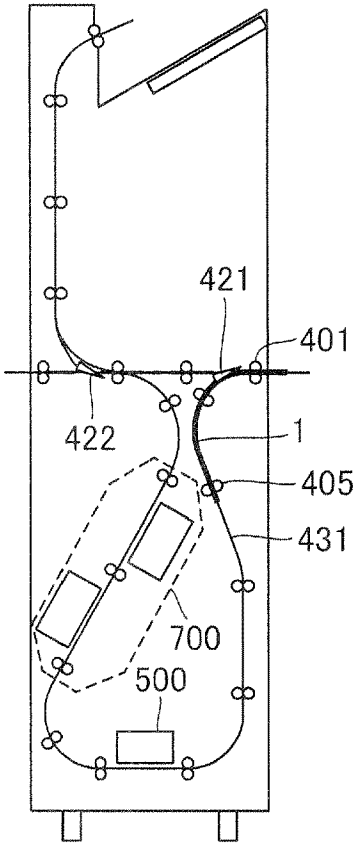
FIG. 13A is a schematic diagram illustrating the sheet conveyance operation in a colorimetric job and a double-sides registration job.

In the case of the colorimetric job, i.e., Yes in Step S3, the first flap 421 serving as the first guide member is positioned at a position for guiding the sheet to the detection path 431 serving as the first conveyance path and the second flap 422 serving as the second guide member is positioned at a position for guiding the sheet to the discharge path 432 serving as the third conveyance path in Step S10. That is, as illustrated in FIG. 13A, the first flap 421 is held at the upper position and the second flap 422 is held at the lower position.

Based on a command of the profile creating portion 301, the image forming apparatus 100 forms a colorimetric image pattern on the sheet in Step S11 and then the adjustment unit 400 receives the sheet in Step S12. The sheet 1 that has been conveyed into the through path 430 at first is guided to the detection path 431 by the first flap 421 in Step S13 (see FIG. 13A). Then, as the sheet 1 arrives at the horizontal portion 431*b* of the detection path 431 and passes through the reading region of the color sensor 500, the color sensor 500 conducts a colorimetric operation to measure spectral reflectance of each patch image in the image pattern in Step S14 (see FIG. 13B).

Colorimetric results of the color sensor 500 is transmitted to the image forming apparatus 100 through the communication portion 450 to notify to the Lab calculation portion 303 in Step S15. The Lab calculation portion 303 converts the spectral reflectance of each patch image into the coordinates of the L*a*b* color space in accordance with the abovementioned method and calculates the value of ΔE. The profile creating portion 301 creates an output ICC profile based on the calculation result of the Lab calculation portion 303 and on a CMYK signal used in outputting the image pattern and updates the output ICC profile stored in the memory 304 in Step S16.

In parallel with the processes described above, operations for discharging the sheet on which the colorimetric operation has been made by the color sensor 500 are conducted in the adjustment unit 400 in Steps S17 through S19. Firstly, the sheet 1 that has passed through the reading region of the color sensor 500 arrives at the merging portion with the through path 430 through an ascending portion 431*c* of the detection path 431 and is conveyed into the through path 430 once in Step S17 (FIG. 13C). Next, the sheet 1 that has been delivered by the third roller 403 of the through path 430 is guided by the second flap 422 to the discharge path 432 in Step S18 (see FIG. 13D). Then, the sheet 1 that has conveyed upward through the discharge path 432 is discharged out of the casing of the adjustment unit 400 and is stacked on the discharged-sheet stacking portion 425 in Step S19 (see FIG. 13E).

In the case of the double-sides registration job, i.e., No in Step S3, processes related to the conveyance of the sheet are common with the case of the colorimetric job. That is, in the case of executing the double-sides registration job, the first flap 421 is positioned at the position for guiding the sheet to the detection path 431 and the second flap 422 is positioned at the position for guiding the sheet to the discharge path 432 in Step S20.

Based on a command of the profile creating portion 301, the image forming apparatus 100 forms an image pattern for double-sides registration on the sheet in Step S21 and then the adjustment unit 400 receives the sheet in Step S22. The sheet 1 that has been conveyed into the through path 430 at first is guided to the detection path 431 by the first flap 421 in Step S23 (see FIG. 13A). Then, as the sheet 1 arrives at the ascending portion 431*c* of the detection path 431 and passes through the reading regions of the CISs 701 and 702 of the double-sides registration portion 700, the sheet 1 and the test patterns on the sheet 1 are read by the CISs 701 and 702 in Step S24.

The image data read by the CISs 701 and 702 is processed by the image processing unit 460 to calculate geometric adjustment amounts in Step S25. The calculated geometric adjustment amounts are transmitted to the image forming apparatus 100 through the communication portion 450 and are registered in the sheet library 900 in Step S26.

In parallel with the processes described above, operations for discharging the sheet on which the measurement has been conducted by the double-sides registration portion 700 are conducted in the adjustment unit 400 in Steps S27 through S29. Similarly to the case of the colorimetric job, the sheet 1 that has passed through the reading region of the CISs 701 and 702 of the double-sides registration portion 700 is once conveyed into the through path 430 in Step S27 (FIG. 13C) and is guided by the second flap 422 to the discharge path 432 in Step S28 (see FIG. 13D). Then, the sheet 1 that has conveyed upward through the discharge path 432 is discharged out of the casing of the adjustment unit 400 and is stacked on the discharged-sheet stacking portion 425 in Step S29 (see FIG. 13E).

The abovementioned processes are repeatedly performed for each sheet of a number of sheets specified by the job. Then, after completing a process on a final sheet, i.e., Yes in Step S8, the job is finished in Step S9. Note that while the type of the job is discriminated per every sheet during the process of the same job in the control example illustrated in FIG. 11, it is also possible to arrange such that the type of the job is discriminated in starting the job and the same process with the previous sheet is applied without discriminating the type while processing the job.

As described above, the color sensor 500 and the double-sides registration portion 700 are disposed along the detection path 431 bypassing under the through path 430 and the discharged-sheet stacking portion 425 is provided at the upper part of the adjustment unit 400 in the present embodiment. Then, the sheet which has been measured by the color sensor 500 or the double-sides registration portion 700 is discharged onto the discharged-sheet stacking portion 425 through the discharge path 432 that is branched from the through path 430 and extends upward.

Here, there is a possibility that accuracy of the detection results of the color sensor 500 and the double-sides registration portion 700 drops by a thermochromism phenomenon and/or thermal noise in a case where peripheral temperature of the sensors is high. Due to that, the color sensor 500 and the double-sides registration portion 700 are disposed along the detection path 431 provided under the through path 430 in the present embodiment so as to reduce the drop of the measuring accuracy otherwise caused by heat of the sheet that has been heated up in the image forming operation. Still further, because the detection path 431 is a conveyance path through which basically no sheet of the normal job passes and conveyance frequency thereof is low as compared to that of the through path 430, it is advantageous in the reduction of the thermal effect. Note that it is also conceivable to provide a cooling period before executing the colorimetric job or the double-sides registration job or to dispose a cooling fan in the adjustment unit 400 in order to avoid the drop of the measuring accuracy caused by the thermal effect. However, as compared to these alternative configurations, the cooling period or the cooling fan are not necessary (or may be least) in the present embodiment, so that it is advantageous in terms of improvement of productivity and cost reduction of the image forming system 100S.

Still further, the convenience of the image forming system 100S can be improved because the adjustment unit 400 is arranged such that the image pattern of the sheet which has been measured by the color sensor 500 or the double-sides registration portion 700 is discharged on the discharged-sheet stacking portion 425 of the adjustment unit 400. That is, because the printed product of the normal job is not stacked on the tray of the finisher 600 while being mixed with the sheet on which the image pattern for the colorimetric job or the double-sides registration job has been formed, the user is not necessary to manually sort the printed products. Still further, because the sheet on which the image pattern for the colorimetric job or the double-sides registration job has been formed is discharged to the discharged-sheet stacking portion 425 which is close to the operating portion 180 which is considered to be frequently operated by the user, it is possible to suppress a moving distance of the user.

Still further, because the discharge path 432 and the discharged-sheet stacking portion 425 are disposed above the through path 430 and the color sensor 500 and the double-sides registration portion 700 are disposed under the through path 430 in the present embodiment, it is possible to provide the compact adjustment unit having the advantages as described above.

Note that while the present embodiment has been described such that the sheet of the normal job is always discharged to the tray of the finisher 600 and the sheet of the colorimetric job or the double-sides registration job is always discharged to the discharged-sheet stacking portion 425, it is also possible to arrange such that a sheet discharge destination can be selected. For instance, in a case where the user explicitly selects the destination through the operating portion 180, it is possible to arrange such that even the sheet of the normal job is discharged to the discharged-sheet stacking portion 425. This arrangement makes it possible for the user to take the sheet, on which an image has been formed for a purpose of trial print run, from the discharged-sheet stacking portion 425 of the adjustment unit 400 disposed closely to the operating portion 180 without walking to the tray of the finisher 600.

Extension Tray

Figure 14A:
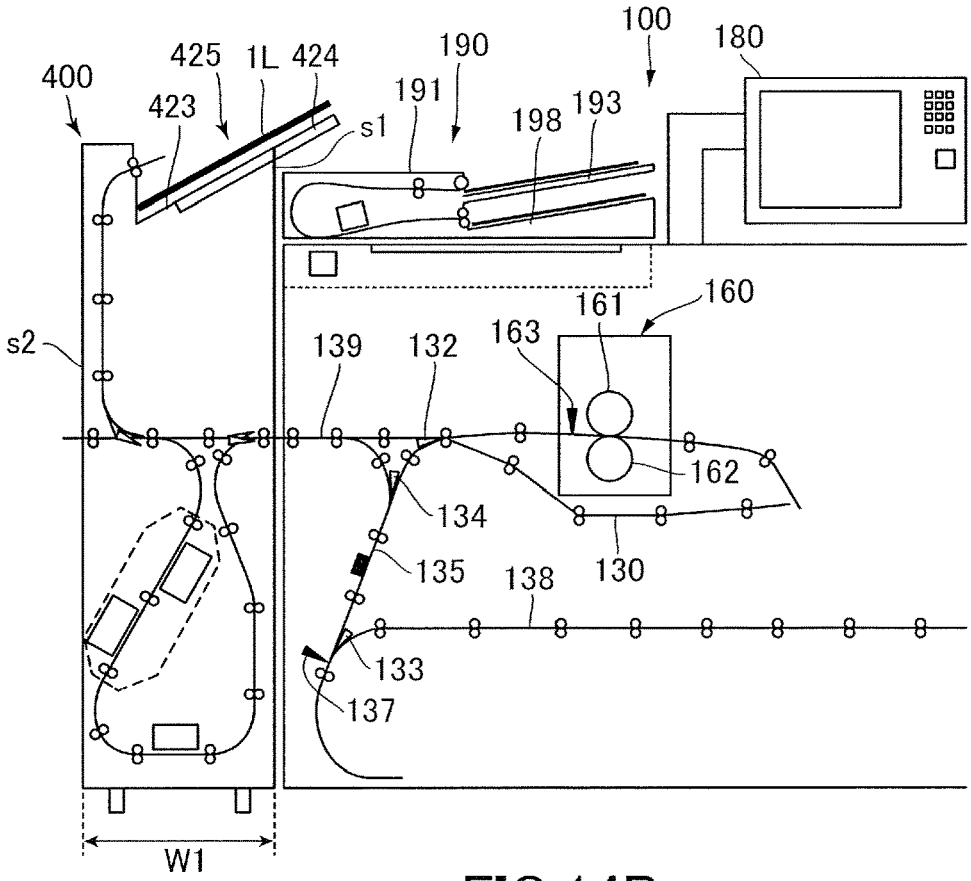
FIG. 14A is a schematic diagram illustrating an extension tray.
Figure 14B:
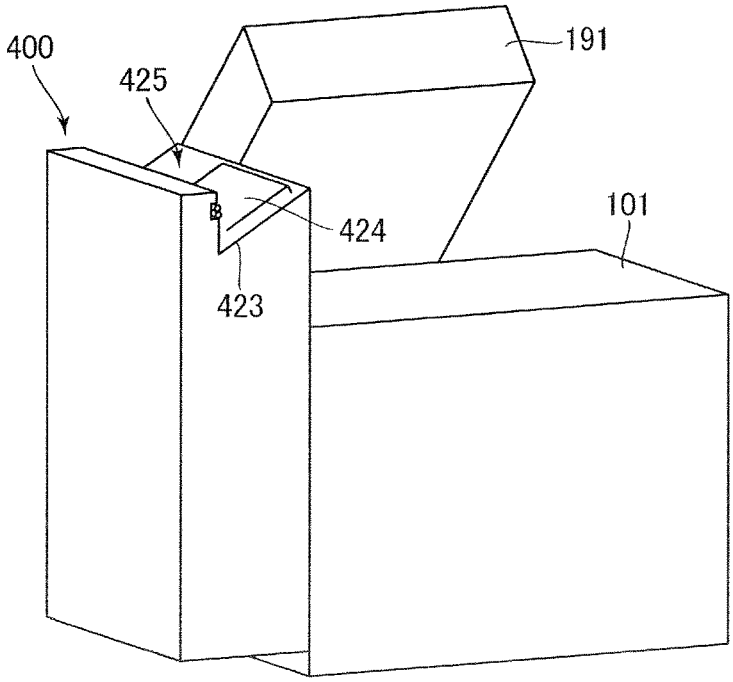
FIG. 14B is a perspective view illustrating the extension tray.

Here, the fixed tray 423 and the extension tray 424 provided on the discharged-sheet stacking portion 425 of the adjustment unit 400 will be described with reference to FIGS. 14A and 14B. The extension tray 424 is slidable with respect to the fixed tray 423 fixed to the casing of the adjustment unit 400 and is movable between a storage position (see FIG. 2) where the extension tray 424 is stored in the fixed tray 423 and a draw-out position where the extension tray 424 is drawn out. As illustrated in FIG. 14A, the extension tray 424 located at the draw-out position supports a long sheet 1L together with the fixed tray 423. Meanwhile, in a case of a short sheet, the fixed tray 423 solely supports the sheet in a condition in which the extension tray 424 is held at the storage position. The 'long sheet' is a sheet having a length in the sheet conveyance direction that is equal to or longer than a long edge of an A3 size sheet, for example.

As illustrated in FIG. 14A, the extension tray 424 located at the draw-out position projects out downstream of a side surface s1 downstream in a sheet discharge direction of the sheet discharge roller 418. In this state, the extension tray 424 is located above an image reading apparatus 190 provided at the upper part of the image forming apparatus 100 and overlaps with the image reading apparatus 190 when viewed in the gravity direction. Meanwhile, the extension tray 424 held in the storage position is positioned inside a width W1 of the adjustment unit 400, i.e., a space between both side surfaces s1 and s2 of the adjustment unit 400 in the horizontal direction in which the image forming apparatus 100, the adjustment unit 400 and the finisher 600 are aligned. In this state, the extension tray 424 is away from a moving locus of the ADF 191 of the image reading apparatus 190 in opening and closing the ADF 191 as illustrated in FIG. 14B and does not impede the opening/closing operation of the ADF 191.

The extension tray 424 enables to stably support a long sheet by utilizing a space above the image reading apparatus 190. Because it is desirable to use, in the double-sides registration job described above, a sheet having a same shape with a sheet for obtaining a printed product as an object to be measured, there is a case where the long sheet is discharged to the discharged-sheet stacking portion 425. Still further, because the color of the printed product can be changed depending on color or surface nature of the sheet itself, it is preferable to prepare the same sheet with the printed product as the object to be measured. Thus, even if a long sheet is discharged on the discharged-sheet stacking portion 425 in such case, the extension tray 424 can support the sheet stably. Note that in a case where the extension tray 424 is projected above the image reading apparatus 190, it is preferable to dispose the feed tray 193 and the sheet discharge tray 198 of the ADF 191 on a side distant horizontally from the adjustment unit 400, i.e., on a right side in FIG. 14A. This arrangement makes it possible to assure accessibility to the feed tray 193 and the sheet discharge tray 198.

Still further, the extension tray 424 is configured to be movable between the storage position, i.e., the first position, and the draw-out position, i.e., the second position, and to be disposed at the position not interfering with the opening/closing operation of the ADF 191 when the extension tray 424 is held in the storage position. Accordingly, the extension tray 424 can load the long sheet without impeding the opening/closing operation of the ADF 191.

Note that while the extension tray 424 located at the draw-out position is located above the image forming apparatus 100 in the present embodiment, the extension tray 424 may be disposed above an upstream apparatus or a downstream apparatus other than the image forming apparatus 100 adjacent the adjustment unit 400. It becomes possible to stably support a long sheet by utilizing a space above the apparatus by disposing the extension tray 424 at the draw-out position at a position overlapping with the apparatus when viewed in the gravity direction.

Still further, while a sheet stacking surface is configured to be extendable by sliding the extension tray 424 with respect to the fixed tray 423 in the present embodiment, the extension tray 424 may be fixed to the fixed tray 423. Such fixed type extension tray 424 is applicable to a configuration in which the image forming apparatus 100 includes no openable ADF 191 or in which the extension tray 424 projects to the side of the downstream apparatus (the left side in FIG. 1).

Conveyance Path from Detection Path to Discharge Path

Figure 15A:
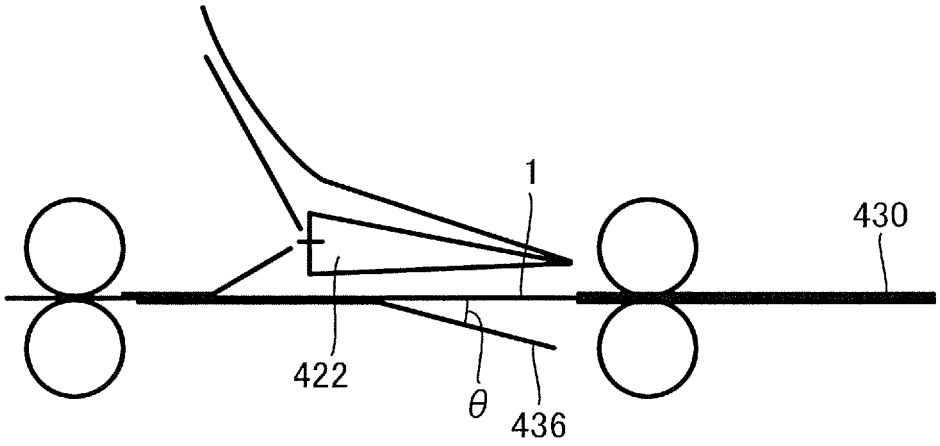
FIG. 15A is an enlarged view illustrating a branch portion of a discharge path and a through path.
Figure 15B:
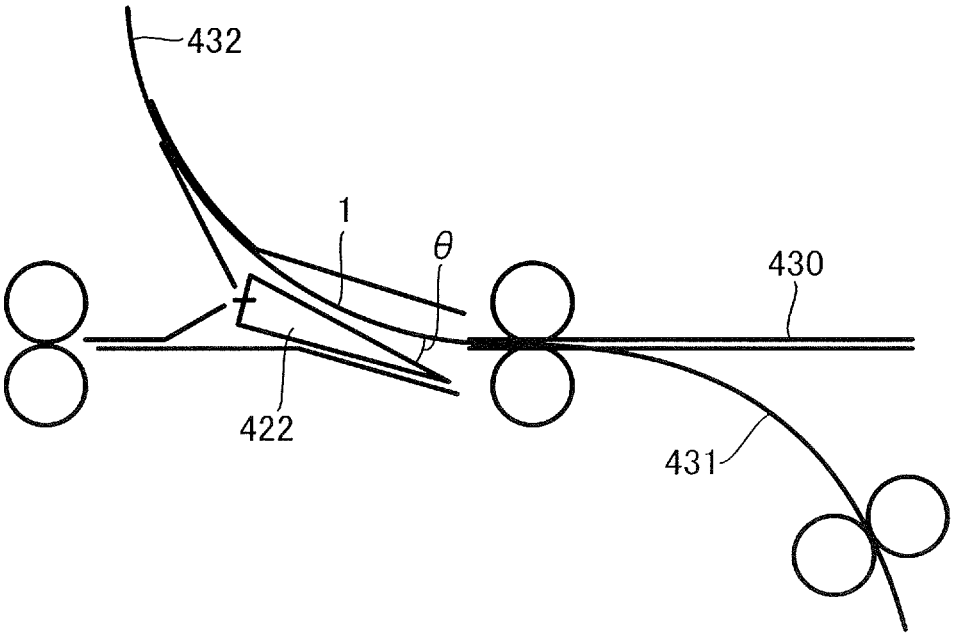
FIG. 15B is an enlarged view illustrating the branch portion of the discharge path and the through path.
Figure 16A:
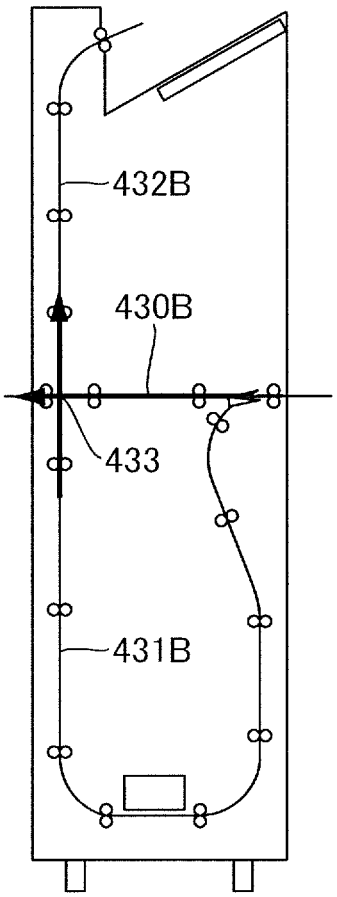
FIG. 16A is a schematic diagram illustrating an adjustment unit of a modified example.

In the present embodiment, the sheet conveyed from the detection path 431 to the discharge path 432 is guided to the discharge path 432 via a part of the through path 430 (see FIG. 13C). An advantage of such arrangement will be described with reference to FIGS. 15 and 16. FIGS. 15A and 15B are schematic diagrams illustrating a periphery of the branch portion where the discharge path 432 branches from the through path 430. FIG. 16A is a schematic diagram illustrating a modified example in which the discharge path 432 and the detection path 431 intersect with the through path 430 like a cross and FIGS. 16B and 16C are schematic diagrams enlarging an intersection part 433.

In the modified example as illustrated in FIG. 16A, a through path 430B extends approximately horizontally and detection and discharge paths 431B and 432B extend approximately vertically in the gravity direction. In this case, there is a possibility that a leading edge of the sheet 1 strongly hits against guides 434 and 435 provided at the intersection part 433 as illustrated in FIGS. 16B and 16C. It may happen because the sheet entering the intersection part 433 from the through path 430B and/or the sheet entering the intersection part 433 from the detection path 431 assumes a large value in terms of an abutment angle θ between guide surfaces of the guides 434 and 435 and the leading edge of the sheet.

Figure 16B:
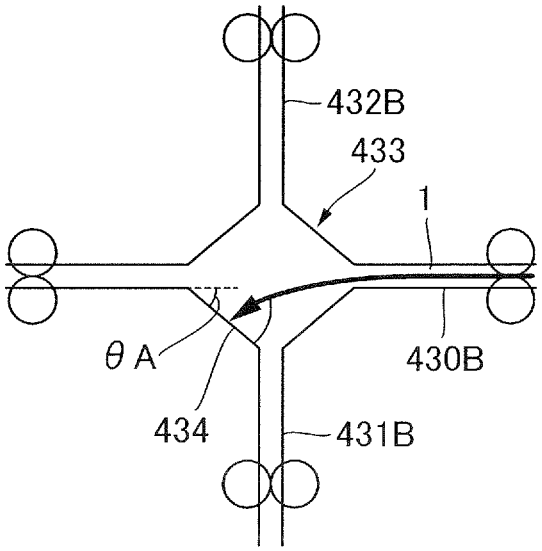
FIG. 16B is an enlarged view of an intersection of conveyance paths.
Figure 16C:
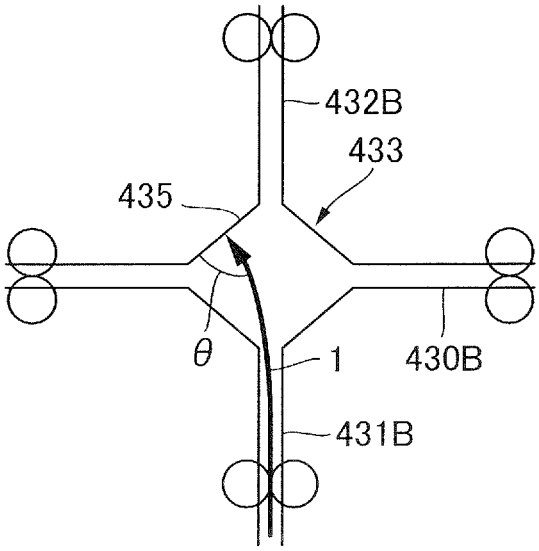
FIG. 16C is an enlarged view of another intersection of the conveyance paths.

While it is preferable to suppress the abutment angle θ to be 30 degrees or less in a case of a thin sheet having low rigidity, the abutment angle may rise up to θA=45 degrees in the arrangement illustrated in FIGS. 16B and 16C. Here, θA is a degree of an angle formed between a straight line extending in the sheet conveyance direction in the through path 430B and a guide surface of the guide 434 of the intersection part 433. In the arrangement in which the two conveyance paths intersect with each other approximately at right angles as illustrated in FIGS. 16B and 16C, it is unable to reduce θA to be less than 45 degrees for all of the guides of the intersection part 433. Still further, in such a case where the leading edge of the sheet 1 is curled or is hanged down by air resistance, the abutment angle is greater than θA. Accordingly, there is a possibility that sheet jamming occurs in the intersection part 433 in the arrangement illustrated in the modified example.

Meanwhile, it is possible to suppress the abutment angle between the leading edge of the sheet 1 and the guide in the arrangement in which the sheet that has sent out of the detection path 431 is conveyed to the discharge path 432 once through the through path 430 like the present embodiment. This arrangement will be described with reference to FIGS. 15A and 15B. The second flap 422 disposed on the branch portion where the discharge path 432 branches from the through path 430 is positioned at an upper position in guiding the sheet 1 to the through path 430 as illustrated in FIG. 15A. Here, the second flap 422 is positioned at a lower position in guiding the sheet 1 to the discharge path 432. Because the third roller 403 delivers the sheet 1 approximately horizontally in the illustrated arrangement at this time, there is a possibility that the sheet 1 abuts against the lower side guide 436 in the case of FIG. 15A and that the sheet 1 abuts against the second flap 422 in the case of FIG. 15B.

However, differing from the modified example in which the conveyance paths intersect with each other with the angle close to right angles, the discharge path 432 is gradually curved upward from a direction along the through path 430 on a side downstream of the third roller 403. Therefore, directions of the lower side guide 436 and the second flap 422 disposed in the branch portion can be set at an angle close to the sheet conveyance direction in the third roller 403, and the abutment angle θ between the leading edge of the sheet 1 and the lower side guide 436 or the second flap 422 can be suppressed to be less. Accordingly, it is possible to stably convey the thin sheet having low rigidity, e.g., a sheet having less grammage, by the arrangement of the present embodiment.

Modified Embodiments

While the present embodiment described above and its modified example have been exemplified by the configuration in which the adjustment unit 400 serving as the measurement apparatus is provided independently of the image forming apparatus 100, the technology of the present disclosure is also applicable to a case where the measuring portion such as the color sensor 500 and the double-sides registration portion 700 is provided within the image forming apparatus. In this case, a first conveyance path through which a sheet on which an image has been formed is conveyed toward a downstream apparatus and a second conveyance path that bypasses under the first conveyance path are provided within the image forming apparatus and the measuring portion is disposed along the second conveyance path. Then, a sheet stacking portion is provided at a position above the first conveyance path and overlapping with the second conveyance path when viewed in the gravity direction to configure such that the sheet measured by the measuring portion is discharged to the sheet stacking portion. This arrangement makes it possible to provide the image forming apparatus which is convenient and which is capable of reducing a drop of measuring accuracy otherwise caused by influence of heat.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-171601, filed on Sep. 13, 2018, which is hereby incorporated by reference herein in its entirety.

What is claimed is:

1. A measurement apparatus comprising:

a first conveyance path configured to receive a first sheet and a second sheet discharged out of an upstream apparatus including an image forming unit and to convey the first sheet to a downstream apparatus including a sheet processing unit, wherein the upstream apparatus, the measurement apparatus and the downstream apparatus are aligned in a horizontal direction;

a second conveyance path branched from the first conveyance path and configured to convey the second sheet;

a color sensor disposed on the second conveyance path and configured to measure an image pattern formed on the second sheet while the second sheet is conveyed through the second conveyance path; and a sheet stacking portion which is provided above the first conveyance path and on which the second sheet discharged out of the second conveyance path is stacked, the sheet stacking portion including an extension tray configured to support the second sheet discharged out of the second conveyance path and to be movable between a first position and a second position, the first position being a position where the extension tray is located inside a width of the measurement apparatus in the horizontal direction, and the second position being a position where the extension tray is located above the upstream apparatus and is overlapped with the upstream apparatus when viewed in a gravity direction.

2. The measurement apparatus according to claim 1, wherein the upstream apparatus further comprises an image reading apparatus provided on a top portion of the image forming apparatus, the image reading apparatus comprising a body portion comprising an image sensor configured to read image information from a document and a document feeder configured to feed the document to the image sensor and to be opened upward with respect the body portion, and wherein the extension tray at the second position is overlapped with the document feeder when viewed in the gravity direction, and the extension tray at the first position is away from a moving locus of the document feeder in opening and closing the document feeder.

3. The measurement apparatus according to claim 1, further comprising:

a first guide member provided on a portion where the second conveyance path branches from the first conveyance path and configured to switch a conveyance path of a sheet between the first conveyance path and the second conveyance path.

4. The measurement apparatus according to claim 1, wherein the color sensor is configured to acquire spectral reflectance of the image pattern on the second sheet.

5. The measurement apparatus according to claim 1, wherein the first conveyance path is a path extending approximately in the horizontal direction.

6. The measurement apparatus according to claim 1, further comprising a fixed tray fixed to a casing of the measurement apparatus, wherein the extension tray is configured to be drawn out from the fixed tray to be moved from the first position to the second position.

7. An image forming system comprising:

an upstream apparatus comprising an image forming unit configured to form an image on a first sheet in accordance with an image forming condition and to form an image pattern on a second sheet;

a downstream apparatus comprising a sheet processing unit configured to perform a sheet process on the first sheet; and a measurement apparatus provided between the upstream apparatus and the downstream apparatus, wherein the upstream apparatus, the measurement apparatus and the downstream apparatus are aligned in a horizontal direction, wherein the measurement apparatus comprises:

a first conveyance path configured to receive the first sheet and the second sheet discharged out of the upstream apparatus and to convey the first sheet to the downstream apparatus;

a second conveyance path branched from the first conveyance path and configured to convey the second sheet;

a color sensor disposed on the second conveyance path and configured to measure the image pattern formed on the second sheet while the second sheet is conveyed through the second conveyance path; and a sheet stacking portion which is provided above the first conveyance path and on which the second sheet discharged out of the second conveyance path is stacked, the sheet stacking portion including an extension tray configured to support the second sheet discharged out of the second conveyance path and to be movable between a first position and a second position, the first position being a position where the extension tray is located inside a width of the measurement apparatus in the horizontal direction, and the second position being a position where the extension tray is located above the upstream apparatus and is overlapped with the upstream apparatus when viewed in a gravity direction, and wherein the image forming condition of the image forming apparatus is changed in accordance with a measurement result of the color sensor.

8. The image forming system according to claim 7, wherein the image forming condition includes a profile for converting input image data inputted to the image forming apparatus, from a color space of the input image data into a color space for forming an image on the first sheet by the image forming unit, and wherein the portion color sensor is configured to measure the image pattern for adjusting the profile.

9. The image forming system according to claim 7, wherein the upstream apparatus further comprises an image reading apparatus provided on a top portion of the image forming apparatus, the image reading apparatus comprising a body portion comprising an image sensor configured to read image information from a document and a document feeder configured to feed the document to the image sensor and to be opened upward with respect the body portion, and wherein the extension tray at the second position is overlapped with the document feeder when viewed in the gravity direction, and the extension tray at the first position is away from a moving locus of the document feeder in opening and closing the document feeder.

* * * * *